US006131084A

United States Patent [19]

Hardwick

[11] Patent Number: 6,131,084

[45] Date of Patent: Oct. 10, 2000

[54] DUAL SUBFRAME QUANTIZATION OF SPECTRAL MAGNITUDES

[75] Inventor: John C. Hardwick, Somerville, Mass.

[73] Assignee: Digital Voice Systems, Inc., Burlington, Mass.

[21] Appl. No.: 08/818,137

[22] Filed: Mar. 14, 1997

[51] Int. Cl.[7] ..... G10L 19/02

[52] U.S. Cl. ..... 704/230; 704/222

[58] Field of Search ..... 704/203, 204, 704/206, 208, 230, 219–223; 455/39

[56] References Cited

U.S. PATENT DOCUMENTS

| | | | |
|---|---|---|---|
| 3,706,929 | 12/1972 | Robinson et al. | 325/15 |
| 3,975,587 | 8/1976 | Dunn et al. | 179/1 SA |
| 3,982,070 | 9/1976 | Flanagan | 179/1 SM |
| 4,091,237 | 5/1978 | Wolnowsky et al. | 179/1 SC |
| 4,422,459 | 12/1983 | Simson | 128/702 |
| 4,583,549 | 4/1986 | Manoli | 128/640 |
| 4,618,982 | 10/1986 | Horvath et al. | 381/36 |
| 4,622,680 | 11/1986 | Zinser | 375/25 |
| 4,720,861 | 1/1988 | Bertrand | 381/36 |
| 4,797,926 | 1/1989 | Bronson et al. | 381/36 |
| 4,821,119 | 4/1989 | Gharavi | 358/136 |
| 4,879,748 | 11/1989 | Picone et al. | 381/49 |
| 4,885,790 | 12/1989 | McAulay et al. | 381/36 |
| 4,905,288 | 2/1990 | Gerson et al. | 704/245 |
| 4,979,110 | 12/1990 | Albrecht et al. | 364/413.83 |
| 5,023,910 | 6/1991 | Thomson | 381/37 |
| 5,036,515 | 7/1991 | Freeburg | 371/5.5 |
| 5,054,072 | 10/1991 | McAulay et al. | 381/31 |
| 5,067,158 | 11/1991 | Arjmand | 381/51 |
| 5,081,681 | 1/1992 | Hardwick et al. | 381/51 |
| 5,091,944 | 2/1992 | Takahashi | 381/36 |
| 5,095,392 | 3/1992 | Shimazaki et al. | 360/40 |
| 5,113,448 | 5/1992 | Nomura et al. | 704/219 |
| 5,195,166 | 3/1993 | Hardwick et al. | 395/2 |
| 5,216,747 | 6/1993 | Hardwick et al. | 395/2 |
| 5,226,084 | 7/1993 | Hardwick et al. | 381/41 |
| 5,226,108 | 7/1993 | Hardwick et al. | 395/2 |

(List continued on next page.)

FOREIGN PATENT DOCUMENTS

| | | |
|---|---|---|
| 123456 | 10/1984 | European Pat. Off. . |
| 154381 | 9/1985 | European Pat. Off. . |
| 92/05539 | 4/1992 | WIPO . |
| 92/10830 | 6/1992 | WIPO . |

OTHER PUBLICATIONS

Digital Speech Processing, Synthesis, and Recognition by Sadaoki Furui, p. 62, p. 135, 1989.

Error–Correcting Codes by W. Wesley Peterson and E. J. Weldon, Jr, p. 1, 121, 220, 1972.

(List continued on next page.)

*Primary Examiner*—David D. Knepper
*Attorney, Agent, or Firm*—Fish & Richardson P.C.

[57] ABSTRACT

Speech is encoded into a 90 millisecond frame of bits for transmission across a satellite communication channel. A speech signal is digitized into digital speech samples that are then divided into subframes. Model parameters that include a set of spectral magnitude parameters that represent spectral information for the subframe are estimated for each subframe. Two consecutive subframes from the sequence of subframes are combined into a block and their spectral magnitude parameters are jointly quantized. The joint quantization includes forming predicted spectral magnitude parameters from the quantized spectral magnitude parameters from the previous block, computing the residual parameters as the difference between the spectral magnitude parameters and the predicted spectral magnitude parameters, combining the residual parameters from both of the subframes within the block, and using vector quantizers to quantize the combined residual parameters into a set of encoded spectral bits. Redundant error control bits may be added to the encoded spectral bits from each block to protect the encoded spectral bits within the block from bit errors. The added redundant error control bits and encoded spectral bits from two consecutive blocks may be combined into a 90 millisecond frame of bits for transmission across a satellite communication channel.

34 Claims, 7 Drawing Sheets

U.S. PATENT DOCUMENTS

| | | | |
|---|---|---|---|
| 5,247,579 | 9/1993 | Hardwick et al. | 381/40 |
| 5,265,167 | 11/1993 | Akamine et al. | 381/40 |
| 5,307,441 | 4/1994 | Tzeng | 704/222 |
| 5,504,773 | 4/1996 | Padowani et al. | 375/200 |
| 5,517,511 | 5/1996 | Hardwick et al. | 371/37.4 |
| 5,596,659 | 1/1997 | Normile et al. | 382/253 |
| 5,630,011 | 5/1997 | Lim et al. | 704/205 |
| 5,696,873 | 12/1997 | Bartkowiak | 704/216 |
| 5,704,003 | 12/1997 | Kleijn et al. | 704/220 |

OTHER PUBLICATIONS

Vector Quantization and Signal Compression by Allen Gersho and Robert M. Gray, pp. 361–362, p. 571, 1992.

Almeida et al., "Harmonic Coding: A Low Bit–Rate, Good–Quality Speech Coding Technique," IEEE (1982), pp. 1664–1667.

Almeida, et al. "Variable–Frequency Synthesis: An Improved Harmonic Coding Scheme", ICASSP (1984), pp. 27.5.1–27.5.4.

Atungsiri et al., "Error Detection and Control for the Parametric Information in CELP Coders", IEEE (1990), pp. 229–232.

Brandstein et al., "A Real–Time Implementation of the Improved MBE Speech Coder", IEEE (1990), pp. 5–8.

Campbell et al., "The New 4800 bps Voice Coding Standard", Mil Speech Tech Conference (Nov. 1989), pp. 64–70.

Chen et al., "Real–Time Vector APC Speech Coding at 4800 bps with Adaptive Postfiltering", Proc. ICASSP (1987), pp. 2185–2188.

Cox et al., "Subband Speech Coding and Matched Convolutional Channel Coding for Mobile Radio Channels," IEEE Trans. Signal Proc., vol. 39, No. 8 (Aug. 1991), pp. 1717–1731.

Digital Voice Systems, Inc., "INMARSAT–M Voice Codec", Version 1.9 (Nov. 18, 1992), pp. 1–145.

Digital Voice Systems, Inc., "The DVSI IMBE Speech Compression System," advertising brochure (May 12, 1993).

Digital Voice Systems, Inc., "The DVSI IMBE Speeck Coder," advertising brochure (May 12, 1993).

Flanagan, J.L., Speech Analysis Synthesis and Perception, Springer–Verlag (1982), pp. 378–386.

Fujimura, "An Approximation to Voice Aperiodicity", IEEE Transactions on Audio and Electroacoutics, vol. AU–16, No. 1 (Mar. 1968), pp. 68–72.

Griffin, et al., "A High Quality 9.6 Kpbs Speech Coding System", Proc. ICASSP 86, Tokyo, Japan, (Apr. 13–20, 1986), pp. 125–128.

Griffin et al., "A New Model–Based Speech Analysis/Synthesis System", Proc. ICASSP 85, Tampa, FL (Mar. 26–29, 1985), pp. 513–516.

Griffin, et al. "A New Pitch Detection Algorithm", Digital Signal Processing, No. 84, Elsevier Science Publishers (1984), pp. 395–399.

Griffin et al., "Multiband Excitation Vocoder" IEEE Transactions on Acoustics, Speech and Signal Processing, vol. 36, No. 8 (1988), pp. 1223–1235.

Griffin, "The Multiband Excitation Vocoder", Ph.D. Thesis, M.I.T., 1987.

Griffin et al. "Signal Estimation from Modified Short–Time Fourier Transform", IEEE Transcations on Acoustics, Speech, and Signal Processing, vol. ASSP–32, No. 2 (Apr. 1984), pp. 236–243.

Hardwick et al., "A 4.8 Kbps Multi–band Excitation Speech Coder," Proceedings from ICASSP, International Conference on Acoustics, Speech and Signal Processing, New York, N.Y. (Apr. 11–14, 1988), pp. 374–377.

Hardwick et al. "A 4.8 Kbps Multi–Band Excitation Speech Coder," Master's Thesis, M.I.T., 1988.

Hardwick et al. "The Application of the IMBE Speech Coder to Mobile Communications," IEEE (1991), pp. 249–252.

Heron, "A 32–Band Sub–band/Transform Coder Incorporating Vector Quantization for Dynamic Bit Allocation", IEEE (1983), pp. 1276–1279.

Levesque et al., "A Proposed Federal Standard for Narrowband Digital Land Mobile Radio", IEEE (1990), pp. 497–501.

Makhoul, "A Mixed–Source Model For Speech Compression And Synthesis", IEEE (1978), pp. 163–166.

Makhoul et al., "Vector Quantization in Speech Coding", IEEE (1985), pp. 1551–1588.

Maragos et al., "Speech Nonlinearities, Modulations, and Energy Operators", IEEE (1991), pp. 421–424.

Mazor et al., "Transform Subbands Coding With Channel Error Control", IEEE (1989), pp. 172–175.

McAulay et al., "Mid–Rate Coding Based on a Sinusoidal Representation of Speech", Proc. IEEE (1985), pp. 945–948.

McAulay et al., Multirate Sinusoidal Transform Coding at Rates From 2.4 Kbps to 8 Kbps., IEEE (1987), pp. 1645–1648.

McAulay et al., "Speech Analysis/Synthesis Based on A Sinusoidal Representation," IEEE Transactions on Acoustics, Speech and Signal Processing V. 34, No. 4, (Aug. 1986), pp. 744–754.

McCree et al., "A New Mixed Excitation LPC Vocoder", IEEE (1991), pp. 593–595.

McCree et al., "Improving The Performance Of A Mixed Excitation LPC Vocoder In Acoustic Noise", IEEE (1992), pp. 137–139.

Rahikka et al., "CELP Coding for Land Mobile Radio Applications," Proc. ICASSP 90, Albuquerque, New Mexico, Apr. 3–6, 1990, pp. 465–468.

Rowe et al., "A Robust 2400bit/s MBE–LPC Speech Coder Incorporating Joing Source and Channel Coding," IEEE (1992), pp. 141–144.

Secrest, et al., "Postprocessing Techniques for Voice Pitch Trackers", ICASSP, vol. 1 (1982), pp. 172–175.

Tribolet et al., Frequency Domain Coding of Speech, IEEE Transactions on Acoustics, Speech and Signal Processing, V. ASSP–27, No. 5, pp. 512–530 (Oct. 1979).

Yu et al., "Discriminant Analysis and Supervised Vector Quantization for Continuous Speech Recognition", IEEE (1990), pp. 685–688.

DUAL SUBFRAME QUANTIZATION OF SPECTRAL MAGNITUDES

BACKGROUND

The invention is directed to encoding and decoding speech.

Speech encoding and decoding have a large number of applications and have been studied extensively. In general, one type of speech coding, referred to as speech compression, seeks to reduce the data rate needed to represent a speech signal without substantially reducing the quality or intelligibility of the speech. Speech compression techniques may be implemented by a speech coder.

A speech coder is generally viewed as including an encoder and a decoder. The encoder produces a compressed stream of bits from a digital representation of speech, such as may be generated by converting an analog signal produced by a microphone using an analog-to-digital converter. The decoder converts the compressed bit stream into a digital representation of speech that is suitable for playback through a digital-to-analog converter and a speaker. In many applications, the encoder and decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at high rates (greater than 8 kbs), mid-rates (3–8 kbs) and low rates (less than 3 kbs). Recently, mid-rate and low-rate speech coders have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Vocoders are a class of speech coders that have been shown to be highly applicable to mobile communications. A vocoder models speech as the response of a system to excitation over short time intervals. Examples of vocoder systems include linear prediction vocoders, homomorphic vocoders, channel vocoders, sinusoidal transform coders ("STC"), multiband excitation ("MBE") vocoders, and improved multiband excitation ("IMBE™") vocoders. In these vocoders, speech is divided into short segments (typically 10–40 ms) with each segment being characterized by a set of model parameters. These parameters typically represent a few basic elements of each speech segment, such as the segment's pitch, voicing state, and spectral envelope. A vocoder may use one of a number of known representations for each of these parameters. For example the pitch may be represented as a pitch period, a fundamental frequency, or a long-term prediction delay. Similarly the voicing state may be represented by one or more voiced/unvoiced decisions, by a voicing probability measure, or by a ratio of periodic to stochastic energy. The spectral envelope is often represented by an all-pole filter response, but also may be represented by a set of spectral magnitudes or other spectral measurements.

Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

One speech model which has been shown to provide high quality speech and to work well at medium to low bit rates is the Multi-Band Excitation (MBE) speech model developed by Griffin and Lim. This model uses a flexible voicing structure that allows it to produce more natural sounding speech, and which makes it more robust to the presence of acoustic background noise. These properties have caused the MBE speech model to be employed in a number of commercial mobile communication applications.

The MBE speech model represents segments of speech using a fundamental frequency, a set of binary voiced/unvoiced (V/UV) metrics, and a set of spectral magnitudes. A primary advantage of the MBE model over more traditional models is in the voicing representation. The MBE model generalizes the traditional single V/UV decision per segment into a set of decisions, each representing the voicing state within a particular frequency band. This added flexibility in the voicing model allows the MBE model to better accommodate mixed voicing sounds, such as some voiced fricatives. In addition this added flexibility allows a more accurate representation of speech that has been corrupted by acoustic background noise. Extensive testing has shown that this generalization results in improved voice quality and intelligibility.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder converts the received bit stream back into individual frames. As part of this conversion, the decoder may perform deinterleaving and error control decoding to correct or detect bit errors. The decoder then uses the frames of bits to reconstruct the MBE model parameters, which the decoder uses to synthesize a speech signal that perceptually resembles the original speech to a high degree. The decoder may synthesize separate voiced and unvoiced components, and then may add the voiced and unvoiced components to produce the final speech signal.

In MBE-based systems, the encoder uses a spectral magnitude to represent the spectral envelope at each harmonic of the estimated fundamental frequency. Typically each harmonic is labeled as being either voiced or unvoiced, depending upon whether the frequency band containing the corresponding harmonic has been declared voiced or unvoiced. The encoder then estimates a spectral magnitude for each harmonic frequency. When a harmonic frequency has been labeled as being voiced, the encoder may use a magnitude estimator that differs from the magnitude estimator used when a harmonic frequency has been labeled as being unvoiced. At the decoder, the voiced and unvoiced harmonics are identified, and separate voiced and unvoiced components are synthesized using different procedures. The unvoiced component may be synthesized using a weighted overlap-add method to filter a white noise signal. The filter is set to zero all frequency regions declared voiced while otherwise matching the spectral magnitudes labeled unvoiced. The voiced component is synthesized using a tuned oscillator bank, with one oscillator assigned to each harmonic that has been labeled as being voiced. The instantaneous amplitude, frequency and phase are interpolated to match the corresponding parameters at neighboring segments.

MBE-based speech coders include the IMBE™ speech coder and the AMBE® speech coder. The AMBE® speech coder was developed as an improvement on earlier MBE-based techniques. It includes a more robust method of estimating the excitation parameters (fundamental frequency and V/UV decisions) which is better able to track the variations and noise found in actual speech. The AMBE® speech coder uses a filterbank that typically includes sixteen channels and a non-linearity to produce a set of channel outputs from which the excitation parameters can be reliably estimated. The channel outputs are combined and processed to estimate the fundamental frequency and then the channels within each of several (e.g., eight) voicing bands are processed to estimate a V/UV decision (or other voicing metric) for each voicing band.

The AMBE® speech coder also may estimate the spectral magnitudes independently of the voicing decisions. To do this, the speech coder computes a fast Fourier transform ("FFT") for each windowed subframe of speech and then averages the energy over frequency regions that are multiples of the estimated fundamental frequency. This approach may further include compensation to remove from the estimated spectral magnitudes artifacts introduced by the FFT sampling grid.

The AMBE® speech coder also may include a phase synthesis component that regenerates the phase information used in the synthesis of voiced speech without explicitly transmitting the phase information from the encoder to the decoder. Random phase synthesis based upon the V/UV decisions may be applied, as in the case of the IMBE™ speech coder. Alternatively, the decoder may apply a smoothing kernel to the reconstructed spectral magnitudes to produce phase information that may be perceptually closer to that of the original speech than is the randomly-produced phase information.

The techniques noted above are described, for example, in Flanagan, *Speech Analysis, Synthesis and Perception*, Springer-Verlag, 1972, pages 378–386 (describing a frequency-based speech analysis-synthesis system); Jayant et al., *Digital Coding of Waveforms*, Prentice-Hall, 1984 (describing speech coding in general); U.S. Pat. No. 4,885,790 (describing a sinusoidal processing method); U.S. Pat. No. 5,054,072 (describing a sinusoidal coding method); Almeida et al., "Nonstationary Modeling of Voiced Speech", *IEEE TASSP*, Vol. ASSP-31, No. 3, June 1983, pages 664–677 (describing harmonic modeling and an associated coder); Almeida et al., "Variable-Frequency Synthesis: An Improved Harmonic Coding Scheme", *IEEE Proc. ICASSP* 84, pages 27.5.1–27.5.4 (describing a polynomial voiced synthesis method); Quatieri et al., "Speech Transformations Based on a Sinusoidal Representation", *IEEE TASSP*, Vol, ASSP34, No. 6, December. 1986, pages 1449–1986 (describing an analysis-synthesis technique based on a sinusoidal representation); McAulay et al., "Mid-Rate Coding Based on a Sinusoidal Representation of Speech", Proc. *ICASSP* 85, pages 945–948, Tampa, Fla., March 26–29, 1985 (describing a sinusoidal transform speech coder); Griffin, "Multiband Excitation Vocoder", Ph.D. Thesis, M.I.T, 1987 (describing the Multi-Band Excitation (MBE) speech model and an 8000 bps MBE speech coder); Hardwick, "A 4.8 kbps Multi-Band Excitation Speech Coder", SM. Thesis, M.I.T, May 1988 (describing a 4800 bps Multi-Band Excitation speech coder); Telecommunications Industry Association (TIA), "APCO Project 25 Vocoder Description", Version 1.3, Jul. 15, 1993, IS102BABA (describing a 7.2 kbps IMBE™ speech coder for APCO Project 25 standard); U.S. Pat. No. 5,081,681 (describing IMBEM™ random phase synthesis); U.S. Pat. No. 5,247,579 (describing a channel error mitigation method and formant enhancement method for MBE-based speech coders); U.S. Pat. No. 5,226,084 (describing quantization and error mitigation methods for MBE-based speech coders); U.S. Pat. No. 5,517,511 (describing bit prioritization and FEC error control methods for MBE-based speech coders).

SUMMARY OF THE INVENTION

The invention features a new AMBE® speech coder for use in a satellite communication system to produce high quality speech from a bit stream transmitted across a mobile satellite channel at a low data rate. The speech coder combines low data rate, high voice quality, and robustness to background noise and channel errors. This promises to advance the state of the art in speech coding for mobile satellite communications. The new speech coder achieves high performance through a new dual-subframe spectral magnitude quantizer that jointly quantizes the spectral magnitudes estimated from two consecutive subframes. This quantizer achieves fidelity comparable to prior art systems while using fewer bits to quantize the spectral magnitude parameters. AMBE® speech coders are described generally in U.S. Application Ser. No. 08/222,119, filed Apr. 4, 1994 and entitled "ESTIMATION OF EXCITATION PARAMETERS"; U.S. Application Ser. No. 08/392,188, filed Feb. 22, 1995 and entitled "SPECTRAL REPRESENTATIONS FOR MULTI-BAND EXCITATION SPEECH CODERS"; and U.S. Application Ser. No. 08/392,099, filed Feb. 22, 1995 and entitled "SYNTHESIS OF SPEECH USING REGENERATED PHASE INFORMATION", all of which are incorporated by reference.

In one aspect, generally, the invention features a method of encoding speech into a 90 millisecond frame of bits for transmission across a satellite communication channel. A speech signal is digitized into a sequence of digital speech samples, the digital speech samples are divided into a sequence of subframes nominally occurring at intervals of 22.5 milliseconds, and a set of model parameters is estimated for each of the subframes. The model parameters for a subframe include a set of spectral magnitude parameters that represent the spectral information for the subframe. Two consecutive subframes from the sequence of subframes are combined into a block and the spectral magnitude parameters from both of the subframes within the block are jointly quantized. The joint quantization includes forming predicted spectral magnitude parameters from the quantized spectral magnitude parameters from the previous block, computing residual parameters as the difference between the spectral magnitude parameters and the predicted spectral magnitude parameters for the block, combining the residual parameters from both of the subframes within the block, and using vector quantizers to quantize the combined residual parameters into a set of encoded spectral bits. Redundant error control bits then are added to the encoded spectral bits from each block to protect the encoded spectral bits within the block from bit errors. The added redundant error control bits and encoded spectral bits from two consecutive blocks are then combined into a 90 millisecond frame of bits for transmission across a satellite communication channel.

Embodiments of the invention may include one or more of the following features. The combining of the residual parameters from both of the subframes within the block may include dividing the residual parameters from each of the subframes into frequency blocks, performing a linear transformation on the residual parameters within each of the frequency blocks to produce a set of transformed residual coefficients for each of the subframes, grouping a minority of the transformed residual coefficients from all of the frequency blocks into a prediction residual block average (PRBA) vector and grouping the remaining transformed residual coefficients for each of the frequency blocks into a higher order coefficient (HOC) vector for the frequency block. The PRBA vectors for each subframe may be transformed to produce transformed PRBA vectors and the vector sum and difference for the transformed PRBA vectors for the subframes of a block may be computed to combine the transferred PRBA vectors. Similarly, the vector sum and difference for each frequency block may be computed to combine the two HOC vectors from the two subframes for that frequency block.

The spectral magnitude parameters may represent the log spectral magnitudes estimated for the Multi-Band Excitation ("MBE") speech model. The spectral magnitude parameters may be estimated from a computed spectrum independently of the voicing state. The predicted spectral magnitude parameters may be formed by applying a gain of less than unity to the linear interpolation of the quantized spectral magnitudes from the last subframe in the previous block.

The error control bits for each block may be formed using block codes including Golay codes and Hamming codes. For example, the codes may include one [24,12] extended Golay code, three [23,12] Golay codes, and two [15,11] Hamming codes.

The transformed residual coefficients may be computed for each of the frequency blocks using a Discrete Cosine Transform ("DCT") followed by a linear 2 by 2 transform on the two lowest order DCT coefficients. Four frequency blocks may be used for this computation and the length of each the frequency block may be approximately proportional to the number of spectral magnitude parameters within the subframe.

The vector quantizers may include a three way split vector quantizer using 8 bits plus 6 bits plus 7 bits applied to the PRBA vector sum and a two way split vector quantizer using 8 bits plus 6 bits applied to the PRBA vector difference. The frame of bits may include additional bits representing the error in the transformed residual coefficients which is introduced by the vector quantizers.

In another aspect, generally, the invention features a system for encoding speech into a 90 millisecond frame of bits for transmission across a satellite communication channel. The system includes a digitizer that converts a speech signal into a sequence of digital speech samples, a subframe generator that divides the digital speech samples into a sequence of subframes that each include multiple digital speech samples. A model parameter estimator estimates a set of model parameters that include a set of spectral magnitude parameters for each of the subframes. A combiner combines two consecutive subframes from the sequence of subframes into a block. A dual-frame spectral magnitude quantizer jointly quantizes parameters from both of the subframes within the block. The joint quantization includes forming predicted spectral magnitude parameters from the quantized spectral magnitude parameters from a previous block, computing residual parameters as the difference between the spectral magnitude parameters and the predicted spectral magnitude parameters, combining the residual parameters from both of the subframes within the block, and using vector quantizers to quantize the combined residual parameters into a set of encoded spectral bits. The system also includes an error code encoder that adds redundant error control bits to the encoded spectral bits from each block to protect at least some of the encoded spectral bits within the block from bit errors, and a combiner that combines the added redundant error control bits and encoded spectral bits from two consecutive blocks into a 90 millisecond frame of bits for transmission across a satellite communication channel.

In another aspect, generally, the invention features decoding speech from a 90 millisecond frame that has been encoded as described above. The decoding includes dividing the frame of bits into two blocks of bits, wherein each block of bits represents two subframes of speech. Error control decoding is applied to each block of bits using redundant error control bits included within the block to produce error decoded bits which are at least in part protected from bit errors. The error decoded bits are used to jointly reconstruct spectral magnitude parameters for both of the subframes within a block. The joint reconstruction includes using vector quantizer codebooks to reconstruct a set of combined residual parameters from which separate residual parameters for both of the subframes are computed, forming predicted spectral magnitude parameters from the reconstructed spectral magnitude parameters from a previous block, and adding the separate residual parameters to the predicted spectral magnitude parameters to form the reconstructed spectral magnitude parameters for each subframe within the block. Digital speech samples are then synthesized for each subframe using the reconstructed spectral magnitude parameters for the subframe.

In another aspect, generally, the invention features a decoder for decoding speech from a 90 millisecond frame of bits received across a satellite communication channel. The decoder includes a divider that divides the frame of bits into two blocks of bits. Each block of bits represents two subframes of speech. An error control decoder error decodes each block of bits using redundant error control bits included within the block to produce error decoded bits which are at least in part protected from bit errors. A dual-frame spectral magnitude reconstructor jointly reconstructs spectral magnitude parameters for both of the subframes within a block, wherein the joint reconstruction includes using vector quantizer codebooks to reconstruct a set of combined residual parameters from which separate residual parameters for both of the subframes are computed, forming predicted spectral magnitude parameters from the reconstructed spectral magnitude parameters from a previous block, and adding the separate residual parameters to the predicted spectral magnitude parameters to form the reconstructed spectral magnitude parameters for each subframe within the block. A synthesizer synthesizes digital speech samples for each subframe using the reconstructed spectral magnitude parameters for the subframe.

Other features and advantages of the invention will be apparent from the following description, including the drawings, and from the claims.

DESCRIPTION

Figure 1:
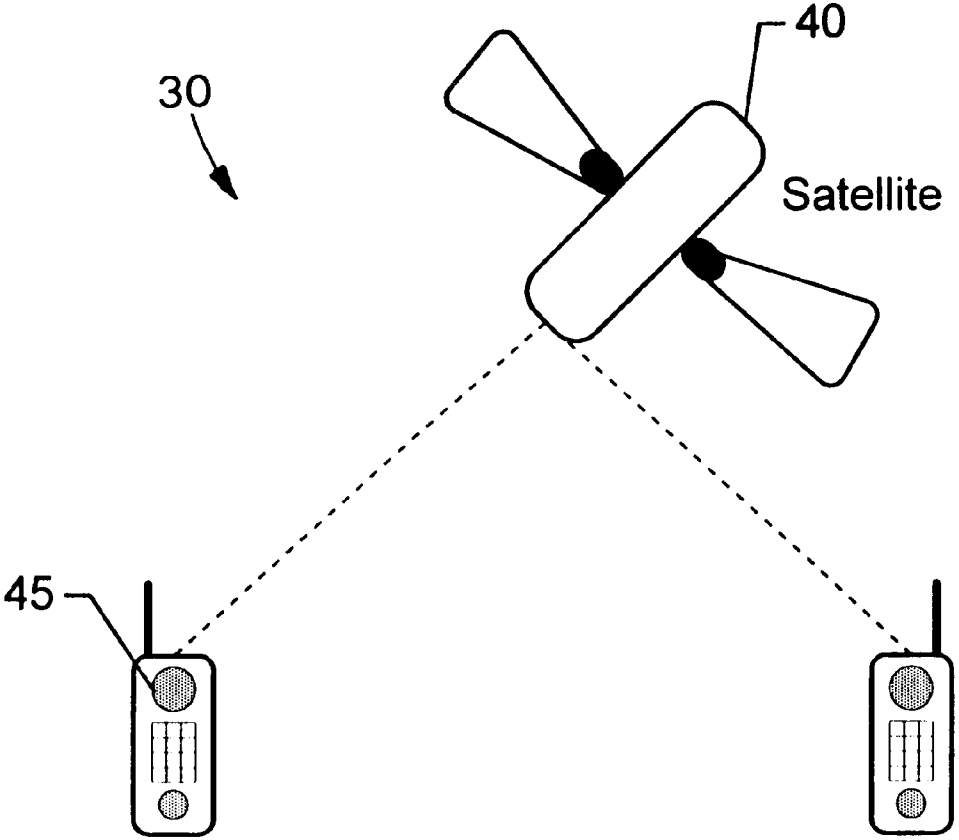
FIG. 1 is a simplified block diagram of a satellite system.

An embodiment of the invention is described in the context of a new AMBE speech coder, or vocoder, for use in the IRIDIUM® mobile satellite communication system 30, as shown in FIG. 1. IRIDIUM® is a global mobile satellite communication system consisting of sixty-six satellites 40 in low earth orbit. IRIDIUM® provides voice communications through handheld or vehicle based user terminals 45 (i.e., mobile phones).

Figure 2:
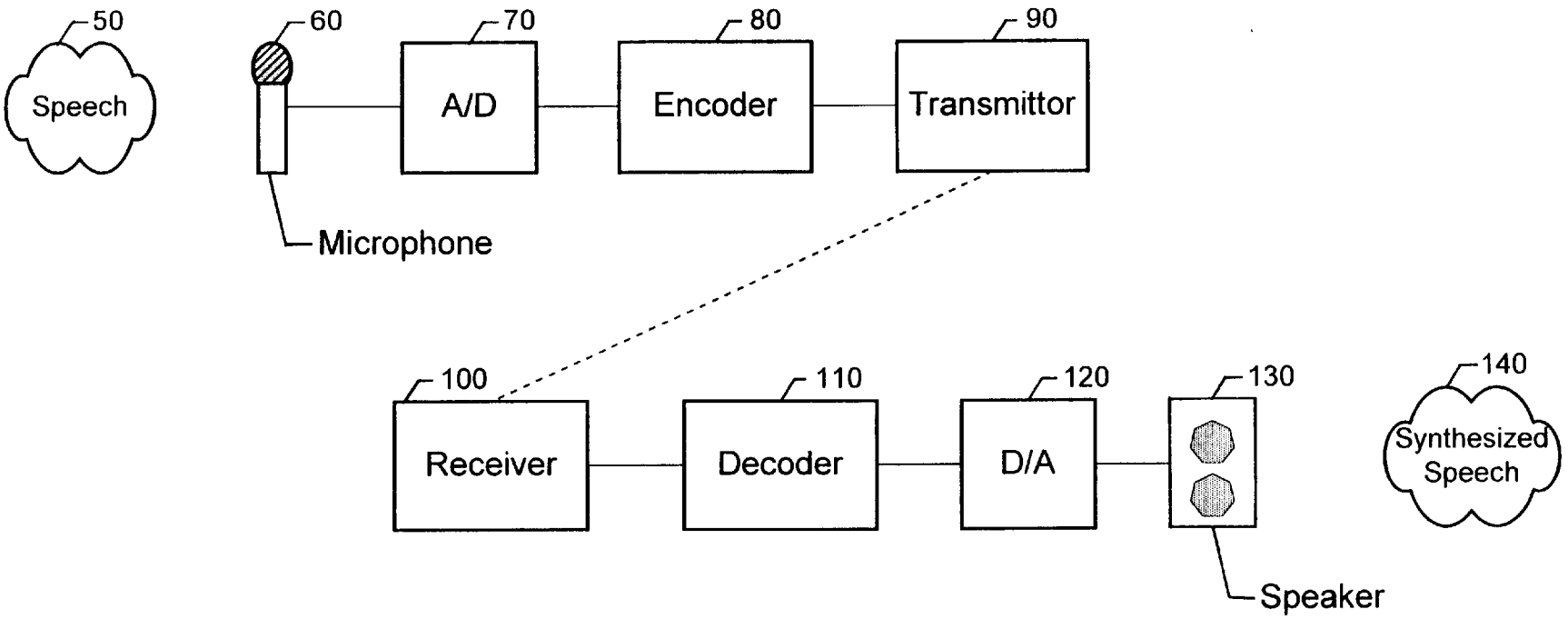
FIG. 2 is a block diagram of a communication link of the system of FIG. 1.

Referring to FIG. 2, the user terminal at the transmitting end achieves voice communication by digitizing speech 50 received through a microphone 60 using an analog-to-digital (A/D) converter 70 that samples the speech at a frequency of 8 kHz. The digitized speech signal passes through a speech encoder 80, where it is processed as described below. The signal is then transmitted across the communication link by a transmitter 90. At the other end of the communication link, a receiver 100 receives the signal and passes it to a decoder 110. The decoder converts the signal into a synthetic digital speech signal. A digital-to-analog (D/A) converter 120 then converts the synthetic digital speech signal into an analog speech signal that is converted into audible speech 140 by a speaker 130.

The communications link uses burst-transmission time-division-multiple-access (TDMA) with a 90 ms frame. Two different data rates for voice are supported: a half-rate mode of 3467 bps (312 bits per 90 ms frame) and a full-rate mode of 6933 bps (624 bits per 90 ms frame). The bits of each frame are divided between speech coding and forward error correction ("FEC") coding to lower the probability of bit errors that normally occur across a satellite communication channel.

Figure 3:
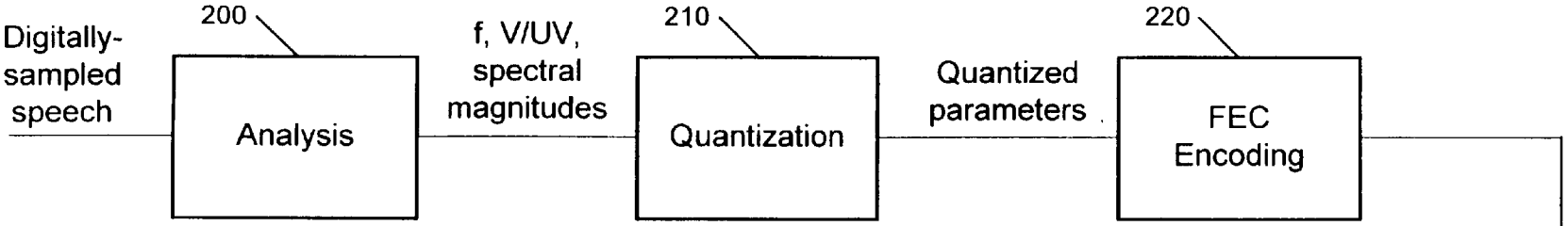
FIGS. 3 and 4 are block diagrams of an encoder and a decoder of the system of FIG. 1.
Figure 4:
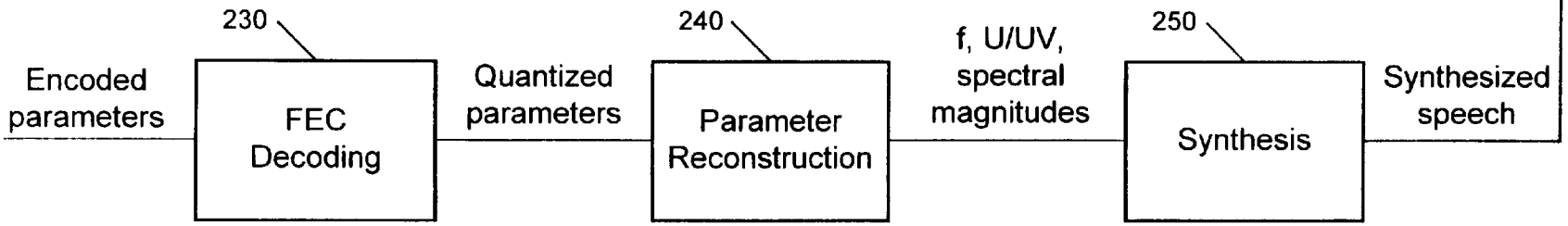

Referring to FIG. 3, the speech coder in each terminal includes an encoder 80 and a decoder 110. The encoder includes three main functional blocks: speech analysis 200, parameter quantization 210, and error correction encoding 220. Similarly, as shown in FIG. 4, the decoder is divided into functional blocks for error correction decoding 230, parameter reconstruction 240 (i.e., inverse quantization) and speech synthesis 250.

The speech coder may operate at two distinct data rates: a full-rate of 4933 bps and a half-rate of 2289 bps. These data rates represent voice or source bits and exclude FEC bits. The FEC bits raise the data rate of the full-rate and half-rate vocoders to 6933 bps and 3467 bps, respectively, as noted above. The system uses a voice frame size of 90 ms which is divided into four 22.5 ms subframes. Speech analysis and synthesis are performed on a subframe basis, while quantization and FEC coding are performed on a 45 ms quantization block that includes two subframes. The use of 45 ms blocks for quantization and FEC coding results in 103 voice bits plus 53 FEC bits per block in the half-rate system, and 222 voice bits plus 90 FEC bits per block in the full-rate system. Alternatively, the number of voice bits and FEC bits can be adjusted within a range with only gradual effect on performance. In the half-rate system, adjustment of the voice bits in the range of 80 to 120 bits with the corresponding adjustment in the FEC bits in the range of 76 to 36 bits can be accomplished. Similarly, in the full-rate system, the voice bits can be adjusted over the range of 180 to 260 bits with the corresponding adjustment in the FEC bits spanning from 132 to 52 bits. The voice and FEC bits for the quantization blocks are combined to form a 90 ms frame.

The encoder 80 first performs speech analysis 200. The first step in speech analysis is filterbank processing on each subframe followed by estimation of the MBE model parameters for each subframe. This involves dividing the input signal into overlapping 22.5 ms subframes using an analysis window. For each 22.5 ms subframe, a MBE subframe parameter estimator estimates a set of model parameters that include a fundamental frequency (inverse of the pitch period), a set of voiced/unvoiced (V/UV) decisions and a set of spectral magnitudes. These parameters are generated using AMBE techniques. AMBE® speech coders are described generally in U.S. Application Ser. No. 08/222,119, filed Apr. 4, 1994 and entitled "ESTIMATION OF EXCITATION PARAMETERS"; U.S. Application Ser. No. 08/392,188, filed Feb. 22, 1995 and entitled "SPECTRAL REPRESENTATIONS FOR MULTI-BAND EXCITATION SPEECH CODERS"; and U.S. Application Ser. No. 08/392,099, filed Feb. 22, 1995 and entitled "SYNTHESIS OF SPEECH USING REGENERATED PHASE INFORMATION", all of which are incorporated by reference.

In addition, the full-rate vocoder includes a time-slot ID that helps to identify out-of-order arrival of TDMA packets at the receiver, which can use this information to place the information in the correct order prior to decoding. The speech parameters fully describe the speech signal and are passed to the encoder's quantization 210 block for further processing.

Figure 5:
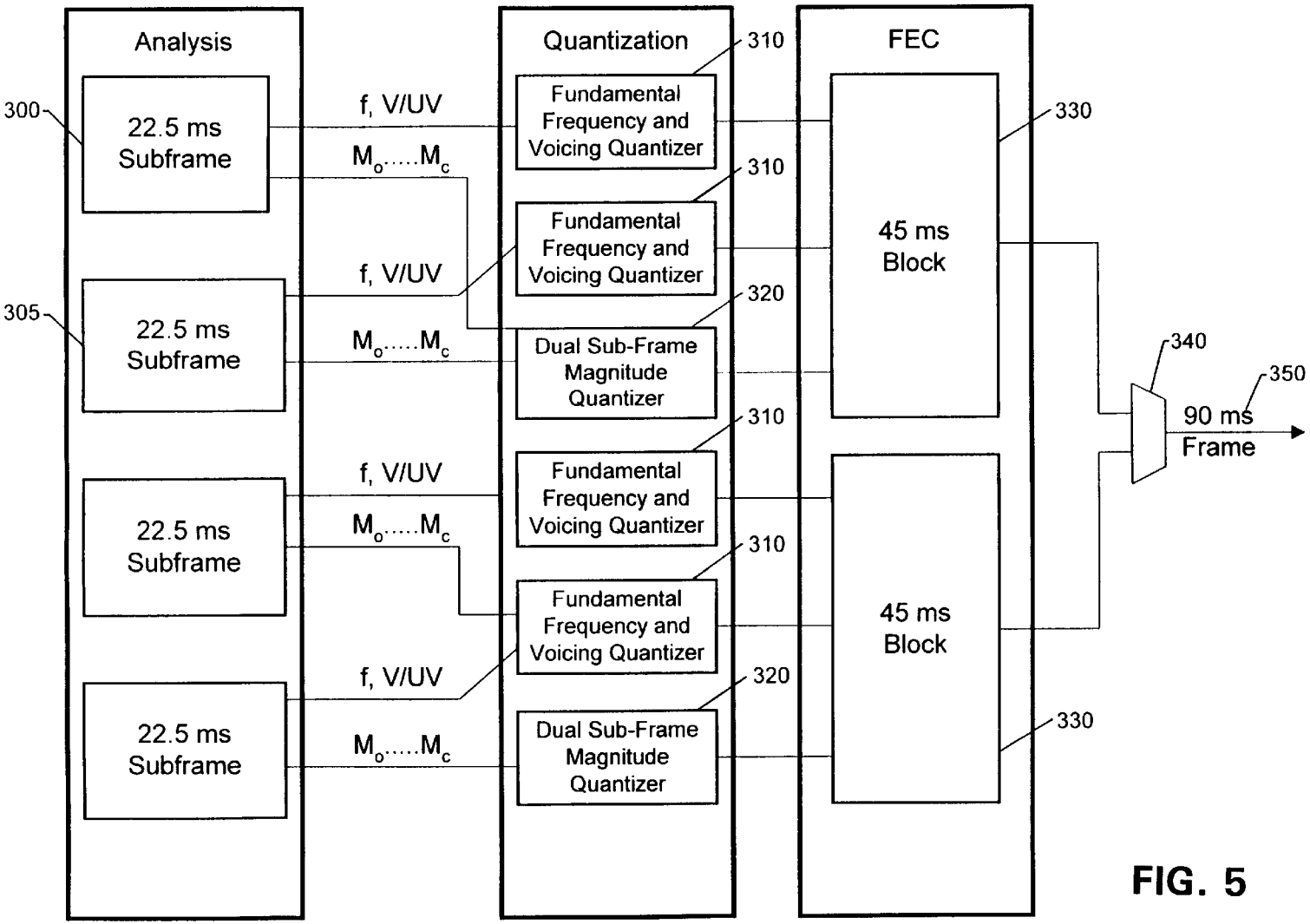
FIG. 5 is a general block diagram of components of the encoder of FIG. 3.

Referring to FIG. 5, once the subframe model parameters 300 and 305 are estimated for two consecutive 22.5 ms subframes within a frame, the fundamental frequency and voicing quantizer 310 encodes the fundamental frequencies estimated for both subframes into a sequence of fundamental frequency bits, and further encodes the voiced/unvoiced (V/UV) decisions (or other voicing metrics) into a sequence of voicing bits.

In the described embodiment, ten bits are used to quantize and encode the two fundamental frequencies. Typically, the fundamental frequencies are limited by the fundamental estimate to a range of approximately [0.008, 0.05] where 1.0 is the Nyquist frequency (8 kHz), and the fundamental quantizer is limited to a similar range. Since the inverse of the quantized fundamental frequency for a given subframe is generally proportional to L, the number of spectral magnitudes for that subframe (L=bandwidth/fundamental frequency), the most significant bits of the fundamental are typically sensitive to bit errors and consequently are given high priority in FEC encoding.

The described embodiment uses eight bits in half-rate and sixteen bits in full-rate to encode the voicing information for both subframes. The voicing quantizer uses the allocated bits to encode the binary voicing state (i.e., 1=voiced and 0=unvoiced) in each of the preferred eight voicing bands, where the voicing state is determined by voicing metrics estimated during speech analysis. These voicing bits have moderate sensitivity to bit errors and hence are given medium priority in FEC encoding.

The fundamental frequency bits and voicing bits are combined in the combiner 330 with the quantized spectral magnitude bits from the dual subframe magnitude quantizer 320, and forward error correction (FEC) coding is performed for that 45 ms block. The 90 ms frame is then formed in a combiner 340 that combines two consecutive 45 ms quantized blocks into a single frame 350.

Figure 6:
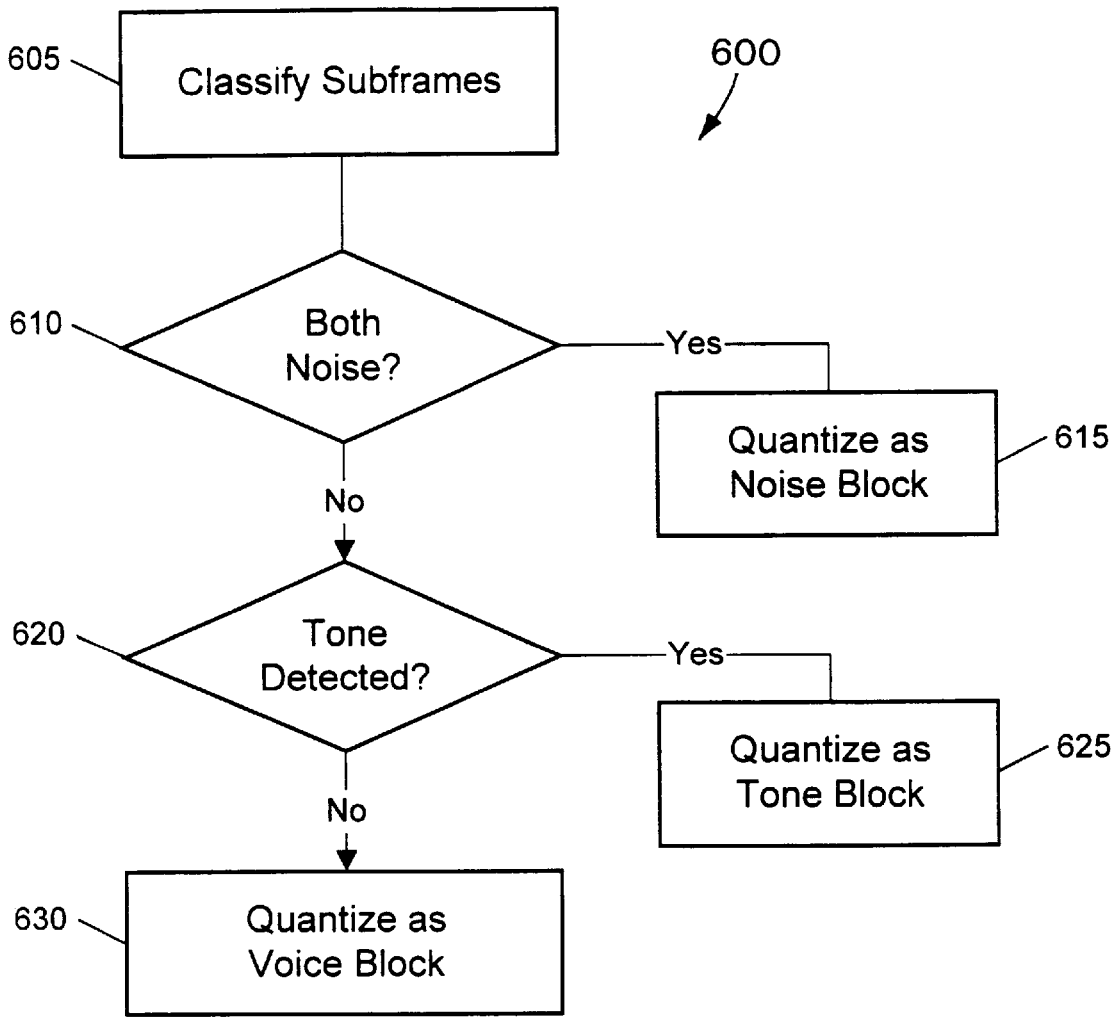
FIG. 6 is a flow chart of the voice and tone detection functions of the encoder.

The encoder incorporates an adaptive Voice Activity Detector (VAD) which classifies each 22.5 ms subframe as either voice, background noise, or a tone according to a procedure 600. As shown in FIG. 6, the VAD algorithm uses local information to distinguish voice subframes from background noise (step 605). If both subframes within each 45 ms block are classified as noise (step 610), then the encoder quantizes the background noise that is present as a special noise block (step 615). When the two 45 ms block comprising a 90 ms frame are both classified as noise, then the system may choose not to transmit this frame to the decoder and the decoder will use previously received noise data in place of the missing frame. This voice activated transmission technique increases performance of the system by only requiring voice frames and occasional noise frames to be transmitted.

The encoder also may feature tone detection and transmission in support of DTMF, call progress (e.g., dial, busy and ringback) and single tones. The encoder checks each 22.5 ms subframe to determine whether the current subframe contains a valid tone signal. If a tone is detected in either of the two subframes of a 45 ms block (step 620), then the encoder quantizes the detected tone parameters (magnitude and index) in a special tone block as shown in Table 1 (step 625) and applies FEC coding prior to transmitting the block to the decoder for subsequent synthesis. If a tone is not detected, then a standard voice block is quantized as described below (step 630).

TABLE 1

Tone Block Bit Representation

| Half-Rate | | Full-Rate | |
|---|---|---|---|
| b [ ] element # | Value | b [ ] element # | Value |
| 0–3 | 15 | 0–7 | 212 |
| 4–9 | 16 | 8–15 | 212 |
| 10–12 | 3 MSB's of Amplitude | 16–18 | 3 MSB's of Amplitude |
| 13–14 | 0 | 19–20 | 0 |
| 15–19 | 5 LSB's of Amplitude | 21–25 | 5 LSB's of Amplitude |
| 20–27 | Detected Tone Index | 26–33 | Detected Tone Index |
| 28–35 | Detected Tone Index | 34–41 | Detected Tone Index |
| 36–43 | Detected Tone Index | 42–49 | Detected Tone Index |
| . | . | . | . |
| . | . | . | . |
| . | . | . | . |
| 84–91 | Detected Tone Index | 194–201 | Detected Tone Index |

TABLE 1-continued

Tone Block Bit Representation

| Half-Rate | | Full-Rate | |
|---|---|---|---|
| b [ ] element # | Value | b [ ] element # | Value |
| 92–99 | Detected Tone Index | 202–209 | Detected Tone Index |
| 100–102 | 0 | 210–221 | 0 |

The vocoder includes VAD and Tone detection to classify each 45 ms block as either a standard Voice block, a special Tone block or a special noise block. In the event a 45 ms block is not classified as a special tone block, then the voice or noise information (as determined by the VAD) is quantized for the pair of subframes comprising that block. The available bits (156 for half-rate, 312 for full-rate) are allocated over the model parameters and FEC coding as shown in Table 2, where the Slot ID is a special parameter used by the full-rate receiver to identify the correct ordering of frames that may arrive out of order. After reserving bits for the excitation parameters (fundamental frequency and voicing metrics), FEC coding and the Slot ID, there are 85 bits available for the spectral magnitudes in the half-rate system and 183 bits available for the spectral magnitudes in the full-rate system. To support the full-rate system with a minimum amount of additional complexity, the full-rate magnitude quantizer uses the same quantizer as the half-rate system plus an error quantizer that uses scalar quantization to encode the difference between the unquantized spectral magnitudes and the quantized output of the half-rate spectral magnitude quantizer.

TABLE 2

Bit Alocation for 45 ms Voice or Noise block

| Vocoder Parameter | Bits (Half-Rate) | Bits (Full-Rate) |
|---|---|---|
| Fund. Freq. | 10 | 16 |
| Voicing Metrics | 8 | 16 |
| Gain | 5 + 5 = 10 | 5 + 5 + 2*2 = 14 |
| PRBA Vector | 8 + 6 + 7 + 8 + 6 = 35 | 8 + 6 + 7 + 8 + 6 + 2*12 = 59 |
| HOC Vector | 4* (7 + 3) = 40 | 4* (7 + 3) + 2* (9 + 9 + 9 + 8) = 110 |
| Slot ID | 0 | 7 |
| FEC | 12 + 3*11 + 2*4 = 53 | 2*12 + 6*11 = 90 |
| Total | 156 | 312 |

A dual-subframe quantizer is used to quantize the spectral magnitudes. The quantizer combines logarithmic companding, spectral prediction, discrete cosine transforms (DCTs) and vector and scalar quantization to achieve high efficiency, measured in terms of fidelity per bit, with reasonable complexity. The quantizer can be viewed as a two dimensional predictive transform coder.

Figure 7:
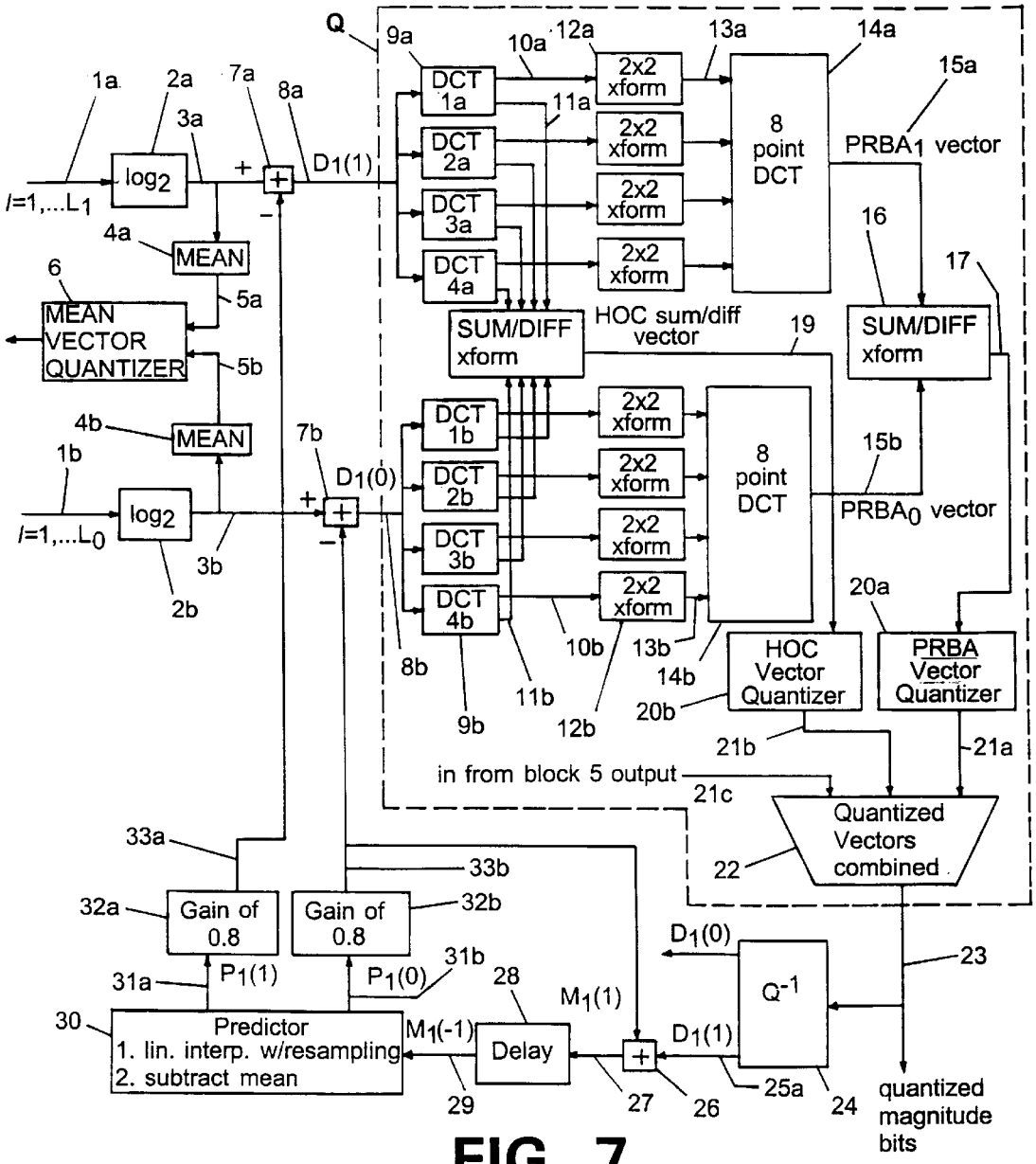
FIG. 7 is a block diagram of a dual subframe magnitude quantizer of the encoder of FIG. 5.

FIG. 7 illustrates the dual subframe magnitude quantizer that receives inputs 1*a* and 1*b* from the MBE parameter estimators for two consecutive 22.5 ms subframes. Input 1*a* represents the spectral magnitudes for odd numbered 22.5 ms subframes and is given an index of 1. The number of magnitudes for subframe number 1 is designated by $L_1$. Input 1*b* represents the spectral magnitudes for the even numbered 22.5 ms subframes and is given the index of 0. The number of magnitudes for subframe number 0 is designated by $L_0$.

Input 1*a* passes through a logarithmic compander 2*a*, which performs a log base 2 operation on each of the $L_1$ magnitudes contained in input 1*a* and generates another vector with $L_1$ elements in the following manner:

$$y[i]=\log_2(x[i]) \text{ for } i=1, 2, \ldots, L_1,$$

where y[i] represents signal 3*a*. Compander 2*b* performs the log base 2 operation on each of the $L_0$ magnitudes contained in input 1*b* and generates another vector with $L_0$ elements in a similar manner:

$$y[i]=\log_2(x[i]) \text{ for } i=1, 2, \ldots, L_0,$$

where y[i] represents signal 3*b*.

Mean calculators 4*a* and 4*b* following the companders 2*a* and 2*b* calculate means 5*a* and 5*b* for each subframe. The mean, or gain value, represents the average speech level for the subframe. Within each frame, two gain values 5*a*, 5*b* are determined by computing the mean of the log spectral magnitudes for each of the two subframes and then adding an offset dependent on the number of harmonics within the subframe.

The mean computation of the log spectral magnitudes 3*a* is calculated as:

where the output, y, represents the mean signal 5*a*.

The mean computation 4*b* of the log spectral $$y = \frac{1}{L_1}\sum_{i=1}^{L_1} x[i] + 0.5\log_2(L_1)$$

magnitudes 3*b* is calculated in a similar manner:

$$y = \frac{1}{L_0}\sum_{i=1}^{L_0} x[i] + 0.5\log_2(L_0)$$

where the output, y, represents the mean signal 5*b*.

Figure 8:
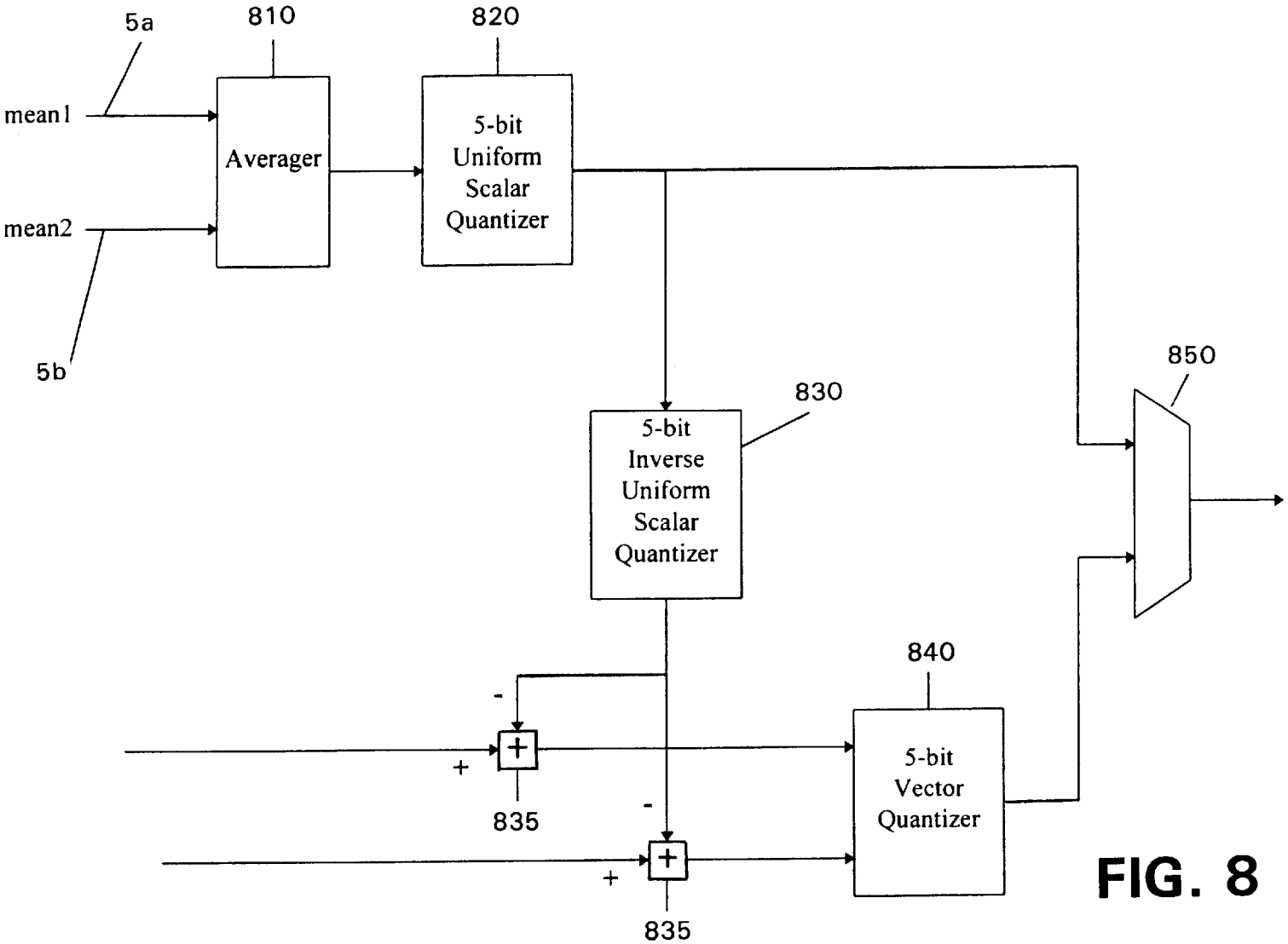
FIG. 8 is a block diagram of a mean vector quantizer of the magnitude quantizer of FIG. 7.

The mean signals 5*a* and 5*b* are quantized by a quantizer 6 that is further illustrated in FIG. 8, where the mean signals 5*a* and 5*b* are referenced, respectively, as mean1 and mean2. First, an averager 810 averages the mean signals. The output of the averager is 0.5*(mean1+mean2). The average is then quantized by a five-bit uniform scalar quantizer 820. The output of the quantizer 820 forms the first five bits of the output of the quantizer 6. The quantizer output bits are then inverse-quantized by a five-bit uniform inverse scalar quantizer 830. Subtracters 835 then subtract the output of the inverse quantizer 830 from the input values mean1 and mean2 to produce inputs to a five-bit vector quantizer 840. The two inputs constitute a two-dimensional vector (z1 and z2) to be quantized. The vector is compared to each two-dimensional vector (consisting of x1(n) and x2(n)) in the table contained in Appendix A ("Gain VQ Codebook (5-bit)"). The comparison is based on the square distance, e, which is calculated as follows:

$$e(n)=[x1(n)-z]2+[x2(n)-z2]^2,$$

for n=0, 1, . . . 31. The vector from Appendix A that minimizes the square distance, e, is selected to produce the last five bits of the output of block 6. The five bits from the output of the vector quantizer 840 are combined with the five bits from the output of the five-bit uniform scalar quantizer 820 by a combiner 850. The output of the combiner 850 is ten bits constituting the output of block 6 which is labeled 21*c* and is used as an input to the combiner 22 in FIG. 7.

Referring further to the main signal path of the quantizer, the log companded input signals 3*a* and 3*b* pass through combiners 7*a* and 7*b* that subtract predictor values 33*a* and 33*b* from the feedback portion of the quantizer to produce a $D_1(1)$ signal 8*a* and a $D_1(0)$ signal 8*b*.

Next, the signals 8*a* and 8*b* are divided into four frequency blocks using the look-up table in Appendix O. The table provides the number of magnitudes to be allocated to each of the four frequency blocks based on the total number of magnitudes for the subframe being divided. Since the number of magnitudes contained in any subframe ranges from a minimum of 9 to a maximum of 56, the table contains values for this same range. The length of each frequency block is adjusted such that they are approximately in a ratio of 0.2:0.225:0.275:0.3 to each other and the sum of the lengths equals the number of spectral magnitudes in the current subframe.

Each frequency block is then passed through a discrete cosine transform (DCT) 9*a* or 9*b* to efficiently decorrelate the data within each frequency block. The first two DCT coefficients 10*a* or 10*b* from each frequency block are then separated out and passed through a 2×2 rotation operation 12*a* or 12*b* to produce transformed coefficients 13*a* or 13*b*. An eight-point DCT 14*a* or 14*b* is then performed on the transformed coefficients 13*a* or 13*b* to produce a prediction residual block average (PRBA) vector 15*a* or 15*b*. The remaining DCT coefficients 11*a* and 11*b* from each frequency block form a set of four variable length higher order coefficient (HOC) vectors.

As described above, following the frequency division, each block is processed by the discrete cosine transform blocks 9*a* or 9*b*. The DCT blocks use the number of input bins, W, and the values for each of the bins, x(0), x(1), . . . , x(W−1) in the following manner:

$$y(k) = \frac{1}{W}\sum_{i=0}^{W-1} x[i]\cos\frac{(2i+1)k\pi}{2W} \quad \text{for } 0 \le k \le (W-1)$$

The values y(0) and y(1) (identified as 10*a*) are separated from the other outputs y(2) through y(W−1) (identified as 11*a*).

A 2×2 rotation operation 12*a* and 12*b* is then performed to transform the 2-element input vector 10*a* and 10*b*, (x(0), x(1)), into a 2-element output vector 13*a* and 13*b*, (y(0),y(1)) by the following rotation procedure:

$$y(0)=x(0)+\text{sqrt}(2)*x(1), \text{ and}$$

$$y(1)=x(0)-\text{sqrt}(2)*x(1).$$

An 8-point DCT is then performed on the four, 2-element vectors, (x(0),x(1), . . . , x(7)) from 13*a* or 13*b* according to the following equation:

$$y(k) = \frac{1}{8}\sum_{i=0}^{7} x[i]\cos\frac{(2i+1)k\pi}{16} \quad \text{for } 0 \le k \le 7$$

The output, y(k), is an 8-element PRBA vector 15*a* or 15*b*.

Once the prediction and DCT transformation of the individual subframe magnitudes have been completed, both PRBA vectors are quantized. The two eight-element vectors are first combined using a sum-difference transformation 16 into a sum vector and a difference vector. In particular, sum/difference operation 16 is performed on the two 8-element PRBA vectors 15*a* and 15*b*, which are represented by x and y respectively, to produce a 16-element vector 17, represented by z, in the following manner:

$$z(i)=x(i)+y(i), \text{ and}$$

$$z(8+i)=x(i)-y(i),$$

for i=0, 1, . . . , 7.

These vectors are then quantized using a split vector quantizer 20*a* where 8, 6, and 7 bits are used for elements 1–2, 3–4, and 5–7 of the sum vector, respectively, and 8 and 6 bits are used for elements 1–3 and 4–7 of the difference vector, respectively. Element 0 of each vector is ignored since it is functionally equivalent to the gain value that is quantized separately.

The quantization of the PRBA sum and difference vectors 17 is performed by the PRBA split-vector quantizer 20*a* to produce a quantized vector 21*a*. The two elements z(1) and z(2) constitute a two-dimensional vector to be quantized. The vector is compared to each two-dimensional vector (consisting of x1(n) and x2(n) in the table contained in Appendix B ("PRBA Sum[1,2] VQ Codebook (8-bit)"). The comparison is based on the square distance, e, which is calculated as follows:

$$e(n)=[x1(n)-z(1)]^2+[x2(n)-z(2)]^2,$$

for n=0,1, . . . , 255.

The vector from Appendix B that minimizes the square distance, e, is selected to produce the first 8 bits of the output vector 21*a*.

Next, the two elements z(3) and z(4) constitute a two-dimensional vector to be quantized. The vector is compared to each two-dimensional vector (consisting of x1(n)) and x2(n) in the table contained in Appendix C ("PRBA Sum [3,4] VQ Codebook (6-bit)"). The comparison is based on the square distance, e, which is calculated as follows:

$$e(n)=[x1(n)-z(3)]^2+[x2(n)-z(4)]^2,$$

for n=0,1, . . . , 63.

The vector from Appendix C which minimizes the square distance, e, is selected to produce the next 6 bits of the output vector 21*a*.

Next, the three elements z(5), z(6) and z(7) constitute a three-dimensional vector to be quantized. The vector is compared to each three-dimensional vector (consisting of x1(n), x2(n) and x3(n) in the table contained in Appendix D ("PRBA Sum[5,7] VQ Codebook (7 bit)"). The comparison is based on the square distance, e, which is calculated as follows:

$$e(n)=[x1(n)-z(5)]^2+[x2(n)-z(6)]^2+[x3(n)-z(7)]^2$$

for n=0,1, . . . , 127.

The vector from Appendix D which minimizes the square distance, e, is selected to produce the next 7 bits of the output vector 21*a*.

Next, the three elements z(9), z(10) and z(11) constitute a three-dimensional vector to be quantized. The vector is compared to each three-dimensional vector (consisting of x1(n), x2(n) and x3(n) in the table contained in Appendix E ("PRBA Dif[1,3] VQ Codebook (8-bit)"). The comparison is based on the square distance, e, which is calculated as follows:

$$e(n)=[x1(n)-z(9)]^2+[x2(n)-z(10)]^2+[x3(n)-z(11)]^2$$

for n=0,1, . . . , 255.

The vector from Appendix E which minimizes the square distance, e, is selected to produce the next 8 bits of the output vector 21*a*.

Finally, the four elements z(12), z(13), z(14) and z(15) constitute a four-dimensional vector to be quantized. The vector is compared to each four-dimensional vector (consisting of x1(n), x2(n), x3(n) and x4(n) in the table contained in Appendix F ("PRBA Dif[4,7] VQ Codebook (6-bit)"). The comparison is based on the square distance, e, which is calculated as follows:

$$e(n)=[x1(n)-z(12)]^2+[x2(n)-z(13)]^2+[x3(n)-z(14)]^2+[x4(n)-z(15)]^2$$

for n=0,1, . . . , 63.

The vector from Appendix F which minimizes the square distance, e, is selected to produce the last 6 bits of the output vector 21*a*.

The HOC vectors are quantized similarly to the PRBA vectors. First, for each of the four frequency blocks, the corresponding pair of HOC vectors from the two subframes are combined using a sum-difference transformation 18 that produces a sum and difference vector 19 for each frequency block.

The sum/difference operation is performed separately for each frequency block on the two HOC vectors 11*a* and 11*b*, referred to as x and y respectively, to produce a vector, $z_m$:

$$\begin{aligned} J &= \max(B_{m0}, B_{m1}) - 2 \\ K &= \min(B_{m0}, B_{m1}) - 2 \\ z_m(i) &= 0.5[x(i) + y(i)] && \text{for } 1 \le i \le K \\ z_m(i) &= \begin{cases} y(i) & \text{if } L_0 > L_1 \\ x(i) & \text{otherwise} \end{cases} && \text{for } K < i \le J \\ z_m(J+i) &= 0.5[x(i) - y(i)] && \text{for } 0 \le i < K. \end{aligned}$$

where $B_{m0}$ and $B_{m1}$, are the lengths of the mth frequency block for, respectively, subframes zero and one, as set forth in Appendix O, and z is determined for each frequency block (i.e., m equals 0 to 3). The J+K element sum and difference vectors $z_m$ are combined for all four frequency blocks (m equals 0 to 3) to form the HOC sum/difference vector 19.

Due to the variable size of each HOC vector, the sum and difference vectors also have variable, and possibly different, lengths. This is handled in the vector quantization step by ignoring any elements beyond the first four elements of each vector. The remaining elements are vector quantized using seven bits for the sum vector and three bits for the difference vector. After vector quantization is performed, the original sum-difference transformation is reversed on the quantized sum and difference vectors. Since this process is applied to all four frequency blocks a total of forty (4*(7+3)) bits are used to vector quantize the HOC vectors corresponding to both subframes.

The quantization of the HOC sum and difference vectors 19 is performed separately on all four frequency blocks by the HOC split-vector quantizer 20*b*. First, the vector $z_m$ representing the mth frequency block is separated and compared against each candidate vector in the corresponding sum and difference codebooks contained in the Appendices. A codebook is identified based on the frequency block to which it corresponds and whether it is a sum or difference code. Thus, the "HOC Sum0 VQ Codebook (7-bit)" of Appendix G represents the sum codebook for frequency block 0. The other codebooks are Appendix H ("HOC Dif0

VQ Codebook (3-bit)"), Appendix I ("HOC Sum1 VQ Codebook (7-bit)"), Appendix J ("HOC Dif1 VQ Codebook (3-bit)"), Appendix K ("HOC Sum2 VQ Codebook (7-bit)"), Appendix L ("HOC Dif2 VQ Codebook (3-bit)"), Appendix M ("HOC Sum2 VQ Codebook (7-bit)"), and Appendix N ("HOC Dif3 VQ Codebook (3-bit)"). The comparison of the vector $z_m$ for each frequency block with each candidate vector from the corresponding sum codebooks is based upon the square distance, e1n for each candidate sum vector (consisting of x1(n), x2(n), x3(n) and x4(n)) which is calculated as:

$$e1_n = \sum_{i=1}^{\min(J,4)} [z(i) - xi(n)]^2 \quad 0 \le n < 128,$$

and the square distance $e2_m$ for each candidate difference vector (consisting of x1(n), x2(n), x3(n) and x4(n)), which is calculated as:

$$e2_m = \sum_{i=1}^{\min(K,4)} [z(J+i) - xi(m)]^2 \quad 0 \le m < 8,$$

where J and K are computed as described above.

The index n of the candidate sum vector from the corresponding sum notebook which minimizes the square distance $e1_n$ is represented with seven bits and the index m of the candidate difference vector which minimizes the square distance $e2_m$ is represented with three bits. These ten bits are combined from all four frequency blocks to form the 40 HOC output bits 21*b*.

Block 22 multiplexes the quantized PRBA vectors 21*a*, the quantized mean 21*b*, and the quantized mean 21*c* to produce output bits 23. These bits 23 are the final output bits of the dual-subframe magnitude quantizer and are also supplied to the feedback portion of the quantizer.

Block 24 of the feedback portion of the dual-subframe quantizer represents the inverse of the functions performed in the superblock labeled Q in the drawing. Block 24 produces estimated values 25*a* and 25*b* of $D_1(1)$ and $D_1(0)$ (8*a* and 8*b*) in response to the quantized bits 23. These estimates would equal $D_1(1)$ and $D_1(0)$ in the absence of quantization error in the superblock labeled Q.

Block 26 adds a scaled prediction value 33*a*, which equals $0.8*P_1(1)$, to the estimate of $D_1(1)$ 25*a* to produce an estimate $M_1(1)$ 27. Block 28 time-delays the estimate $M_1(1)$ 27 by one frame (40 ms) to produce the estimate $M_1(-1)$ 29.

A predictor block 30 then interpolates the estimated magnitudes and resamples them to produce $L_1$ estimated magnitudes after which the mean value of the estimated magnitudes is subtracted from each of the $L_1$ estimated magnitudes to produce the $P_1(1)$ output 31*a*. Next, the input estimated magnitudes are interpolated and resampled to produce $L_0$ estimated magnitudes after which the mean value of the estimated magnitudes is subtracted from each of the $L_0$ estimated magnitudes to produce the $P_1(0)$ output 31*b*.

Block 32*a* multiplies each magnitude in $P_1(1)$ 31*a* by 0.8 to produce the output vector 33*a* which is used in the feedback element combiner block 7*a*. Likewise, block 32*b* multiplies each magnitude in $P_1(1)$ 31*b* by 0.8 to produce the output vector 33*b* which is used in the feedback element combiner block 7*b*. The output of this process is the quantized magnitude output vector 23, which is then combined with the output vector of two other subframes as described above.

Once the encoder has quantized the model parameters for each 45 ms block, the quantized bits are prioritized, FEC encoded and interleaved prior to transmission. The quantized bits are first prioritized in order of their approximate sensitivity to bit errors. Experimentation has shown that the PRBA and HOC sum vectors are typically more sensitive to bits errors than corresponding difference vectors. In addition, the PRBA sum vector is typically more sensitive than the HOC sum vector. These relative sensitivities are employed in a prioritization scheme which generally gives the highest priority to the average fundamental frequency and average gain bits, followed by the PRBA sum bits and the HOC sum bits, followed by the PRBA difference bits and the HOC difference bits, followed by any remaining bits.

A mix of [24,12] extended Golay codes, [23,12] Golay codes and [15,11] Hamming codes are then employed to add higher levels of redundancy to the more sensitive bits while adding less or no redundancy to the less sensitive bits. The half-rate system applies one [24,12] Golay code, followed by three [23,12] Golay codes, followed by two [15,11] Hamming codes, with the remaining 33 bits unprotected. The full-rate system applies two [24,12] Golay codes, followed by six [23,12] Golay codes with the remaining 126 bits unprotected. This allocation was designed to make efficient use of limited number of bits available for FEC. The final step is to interleave the FEC encoded bits within each 45 ms block to spread the effect of any short error bursts. The interleaved bits from two consecutive 45 ms blocks are then combined into a 90 ms frame which forms the encoder output bit stream.

The corresponding decoder is designed to reproduce high quality speech from the encoded bit stream after it is transmitted and received across the channel. The decoder first separates each 90 ms frame into two 45 ms quantization blocks. The decoder then deinterleaves each block and performs error correction decoding to correct and/or detect certain likely bit error patterns. To achieve adequate performance over the mobile satellite channel, all error correction codes are typically decoded up to their full error correction capability. Next, the FEC decoded bits are used by the decoder to reassemble the quantization bits for that block from which the model parameters representing the two subframes within that block are reconstructed.

The AMBE® decoder uses the reconstructed log spectral magnitudes to synthesize a set of phases which are used by the voiced synthesizer to produce natural sounding speech. The use of synthesized phase information significantly lowers the transmitted data rate, relative to a system which directly transmits this information or its equivalent between the encoder and decoder. The decoder then applies spectral enhancement to the reconstructed spectral magnitudes in order to improve the perceived quality of the speech signal. The decoder further checks for bit errors and smoothes the reconstructed parameters if the local estimated channel conditions indicate the presence of possible uncorrectable bit errors. The enhanced and smoothed model parameters (fundamental frequency, V/UV decisions, spectral magnitudes and synthesized phases) are used in speech synthesis.

The reconstructed parameters form the input to the decoder's speech synthesis algorithm which interpolates successive frames of model parameters into smooth 22.5 ms segments of speech. The synthesis algorithm uses a set of harmonic oscillators (or an FFT equivalent at high frequencies) to synthesize the voiced speech. This is added to the output of a weighted overlap-add algorithm to synthesize the unvoiced speech. The sums form the synthesized speech signal which is output to a D-to-A converter for playback over a speaker. While this synthesized speech signal may not be close to the original on a sample-by-sample basis, it is perceived as the same by a human listener.

Other embodiments are within the scope of the following claims.

Table of Gain VQ Codebook (5 Bit) Values

| n | x1(n) | x2(n) |
|---|---|---|
| 0 | −6696 | 6699 |
| 1 | −5724 | 5641 |
| 2 | −4860 | 4854 |
| 3 | −3861 | 3824 |
| 4 | −3132 | 3091 |
| 5 | −2538 | 2630 |
| 6 | −2052 | 2088 |
| 7 | −1890 | 1491 |
| 8 | −1269 | 1627 |
| 9 | −1350 | 1003 |
| 10 | −756 | 1111 |
| 11 | −864 | 514 |
| 12 | −324 | 623 |
| 13 | −486 | 162 |
| 14 | −297 | −109 |
| 15 | 54 | 379 |
| 16 | 21 | −49 |
| 17 | 326 | 122 |
| 18 | 21 | −441 |
| 19 | 522 | −196 |
| 20 | 348 | −686 |
| 21 | 826 | −466 |
| 22 | 630 | −1005 |
| 23 | 1000 | −1323 |
| 24 | 1174 | −809 |
| 25 | 1631 | −1274 |
| 26 | 1479 | −1789 |
| 27 | 2088 | −1960 |
| 28 | 2566 | −2524 |
| 29 | 3132 | −3185 |
| 30 | 3958 | −3994 |
| 31 | 5546 | −5978 |

Table of PRBA Sum [1, 2] VQ Codebook (8 Bit) Values

| n | x1(n) | x2(n) |
|---|---|---|
| 0 | −2022 | −1333 |
| 1 | −1734 | −992 |
| 2 | −2757 | −664 |
| 3 | −2265 | −953 |
| 4 | −1609 | −1812 |
| 5 | −1379 | −1242 |
| 6 | −1412 | −815 |
| 7 | −1110 | −894 |
| 8 | −2219 | −467 |
| 9 | −1780 | −612 |
| 10 | −1931 | −185 |
| 11 | −1570 | −270 |
| 12 | −1484 | −579 |
| 13 | −1287 | −487 |
| 14 | −1327 | −192 |
| 15 | −1123 | −336 |
| 16 | −857 | −791 |
| 17 | −741 | −1105 |
| 18 | −1097 | −615 |
| 19 | −841 | −528 |
| 20 | −641 | −1902 |
| 21 | −554 | −820 |
| 22 | −693 | −623 |
| 23 | −470 | −557 |
| 24 | −939 | −367 |
| 25 | −816 | −235 |
| 26 | −1051 | −140 |

-continued

Table of PRBA Sum [1, 2] VQ Codebook (8 Bit) Values

| n | x1(n) | x2(n) |
|---|---|---|
| 27 | −680 | −184 |
| 28 | −657 | −433 |
| 29 | −449 | −418 |
| 30 | −534 | −286 |
| 31 | −529 | −67 |
| 32 | −2597 | 0 |
| 33 | −2243 | 0 |
| 34 | −3072 | 11 |
| 35 | −1902 | 178 |
| 36 | −1451 | 46 |
| 37 | −1305 | 258 |
| 38 | −1804 | 506 |
| 39 | −1561 | 460 |
| 40 | −3194 | 632 |
| 41 | −2085 | 678 |
| 42 | −4144 | 736 |
| 43 | −2633 | 920 |
| 44 | −1634 | 908 |
| 45 | −1146 | 592 |
| 46 | −1670 | 1460 |
| 47 | −1098 | 1075 |
| 48 | −1056 | 70 |
| 49 | −864 | −48 |
| 50 | −972 | 296 |
| 51 | −841 | 159 |
| 52 | −672 | −7 |
| 53 | −534 | 112 |
| 54 | −675 | 242 |
| 55 | −411 | 201 |
| 56 | −921 | 646 |
| 57 | −839 | 444 |
| 58 | −700 | 1442 |
| 59 | −698 | 723 |
| 60 | −654 | 462 |
| 61 | −482 | 361 |
| 62 | −459 | 801 |
| 63 | −429 | 575 |
| 64 | −376 | −1320 |
| 65 | −280 | −950 |
| 66 | −372 | −695 |
| 67 | −234 | −520 |
| 68 | −198 | −715 |
| 69 | −63 | −945 |
| 70 | −92 | −455 |
| 71 | −37 | −625 |
| 72 | −403 | −195 |
| 73 | −327 | −350 |
| 74 | −395 | −55 |
| 75 | −280 | −180 |
| 76 | −195 | −335 |
| 77 | −90 | −310 |
| 78 | −146 | −205 |
| 79 | −79 | −115 |
| 80 | 36 | −1195 |
| 81 | 64 | −1659 |
| 82 | 46 | −441 |
| 83 | 147 | −391 |
| 84 | 161 | −744 |
| 85 | 238 | −936 |
| 86 | 175 | −552 |
| 87 | 292 | −502 |
| 88 | 10 | −304 |
| 89 | 91 | −243 |
| 90 | 0 | −199 |
| 91 | 24 | −113 |
| 92 | 186 | −292 |
| 93 | 194 | −181 |
| 94 | 119 | −131 |
| 95 | 279 | −125 |
| 96 | −234 | 0 |
| 97 | −131 | 0 |
| 98 | −347 | 86 |
| 99 | −233 | 172 |
| 100 | −113 | 86 |
| 101 | −6 | 0 |

-continued

Table of PRBA Sum [1, 2] VQ Codebook (8 Bit) Values

| n | x1(n) | x2(n) |
|---|---|---|
| 102 | −107 | 208 |
| 103 | −6 | 93 |
| 104 | −308 | 373 |
| 105 | −168 | 503 |
| 106 | −378 | 1056 |
| 107 | −257 | 769 |
| 108 | −119 | 345 |
| 109 | −92 | 790 |
| 110 | −87 | 1085 |
| 111 | −56 | 1789 |
| 112 | 99 | −25 |
| 113 | 188 | −40 |
| 114 | 60 | 185 |
| 115 | 91 | 75 |
| 116 | 188 | 45 |
| 117 | 276 | 85 |
| 118 | 194 | 175 |
| 119 | 289 | 230 |
| 120 | 0 | 275 |
| 121 | 136 | 335 |
| 122 | 10 | 645 |
| 123 | 19 | 450 |
| 124 | 216 | 475 |
| 125 | 261 | 340 |
| 126 | 163 | 800 |
| 127 | 292 | 1220 |
| 128 | 349 | −677 |
| 129 | 439 | −968 |
| 130 | 302 | −358 |
| 131 | 401 | −303 |
| 132 | 495 | −1386 |
| 133 | 578 | −743 |
| 134 | 455 | −517 |
| 135 | 512 | −402 |
| 136 | 294 | −242 |
| 137 | 368 | −171 |
| 138 | 310 | −11 |
| 139 | 379 | −83 |
| 140 | 483 | −165 |
| 141 | 509 | −281 |
| 142 | 455 | −66 |
| 143 | 536 | −50 |
| 144 | 676 | −1071 |
| 145 | 770 | −843 |
| 146 | 642 | −434 |
| 147 | 646 | −575 |
| 148 | 823 | −630 |
| 149 | 934 | −989 |
| 150 | 774 | −438 |
| 151 | 951 | −418 |
| 152 | 592 | −186 |
| 153 | 600 | −312 |
| 154 | 646 | −79 |
| 155 | 695 | −170 |
| 156 | 734 | −288 |
| 157 | 958 | −268 |
| 158 | 836 | −87 |
| 159 | 837 | −217 |
| 160 | 364 | 112 |
| 161 | 418 | 25 |
| 162 | 413 | 206 |
| 163 | 465 | 125 |
| 164 | 524 | 56 |
| 165 | 566 | 162 |
| 166 | 498 | 293 |
| 167 | 583 | 268 |
| 168 | 361 | 481 |
| 169 | 399 | 343 |
| 170 | 304 | 643 |
| 171 | 407 | 912 |
| 172 | 513 | 431 |
| 173 | 527 | 612 |
| 174 | 554 | 1618 |
| 175 | 606 | 750 |
| 176 | 621 | 49 |

-continued

Table of PRBA Sum [1, 2] VQ Codebook (8 Bit) Values

| n | x1(n) | x2(n) |
|---|---|---|
| 177 | 718 | 0 |
| 178 | 674 | 135 |
| 179 | 688 | 238 |
| 180 | 748 | 90 |
| 181 | 879 | 36 |
| 182 | 790 | 198 |
| 183 | 933 | 189 |
| 184 | 647 | 378 |
| 185 | 795 | 405 |
| 186 | 648 | 495 |
| 187 | 714 | 1138 |
| 188 | 795 | 594 |
| 189 | 832 | 301 |
| 190 | 817 | 886 |
| 191 | 970 | 711 |
| 192 | 1014 | −1346 |
| 193 | 1226 | −870 |
| 194 | 1026 | −658 |
| 195 | 1194 | −429 |
| 196 | 1462 | −1410 |
| 197 | 1539 | −1146 |
| 198 | 1305 | −629 |
| 199 | 1460 | −752 |
| 200 | 1010 | −94 |
| 201 | 1172 | −253 |
| 202 | 1030 | 58 |
| 203 | 1174 | −53 |
| 204 | 1392 | −106 |
| 205 | 1422 | −347 |
| 206 | 1273 | 82 |
| 207 | 1581 | −24 |
| 208 | 1793 | −787 |
| 209 | 2178 | −629 |
| 210 | 1645 | −440 |
| 211 | 1872 | −468 |
| 212 | 2231 | −999 |
| 213 | 2782 | −782 |
| 214 | 2607 | −298 |
| 215 | 3491 | −639 |
| 216 | 1802 | −181 |
| 217 | 2108 | −283 |
| 218 | 1828 | 171 |
| 219 | 2065 | 60 |
| 220 | 2458 | 4 |
| 221 | 3132 | −153 |
| 222 | 2765 | 46 |
| 223 | 3867 | 41 |
| 224 | 1035 | 318 |
| 225 | 1113 | 194 |
| 226 | 971 | 471 |
| 227 | 1213 | 353 |
| 228 | 1356 | 228 |
| 229 | 1484 | 339 |
| 230 | 1363 | 450 |
| 231 | 1558 | 540 |
| 232 | 1090 | 908 |
| 233 | 1142 | 589 |
| 234 | 1073 | 1248 |
| 235 | 1368 | 1137 |
| 236 | 1372 | 728 |
| 237 | 1574 | 901 |
| 238 | 1479 | 1956 |
| 239 | 1498 | 1567 |
| 240 | 1588 | 184 |
| 241 | 2092 | 460 |
| 242 | 1798 | 468 |
| 243 | 1844 | 737 |
| 244 | 2433 | 353 |
| 245 | 3030 | 330 |
| 246 | 2224 | 714 |
| 247 | 3557 | 553 |
| 248 | 1728 | 1221 |
| 249 | 2053 | 975 |
| 250 | 2038 | 1544 |
| 251 | 2480 | 2136 |

-continued

Table of PRBA Sum [1, 2] VQ Codebook (8 Bit) Values

| n | x1(n) | x2(n) |
|---|---|---|
| 252 | 2689 | 775 |
| 253 | 3448 | 1098 |
| 254 | 2526 | 1106 |
| 255 | 3162 | 1736 |

Table of PRBA Sum [3, 4] VQ Codebook (6 Bit) Values

| n | x1(n) | x2(n) |
|---|---|---|
| 0 | −1320 | −848 |
| 1 | −820 | −743 |
| 2 | −440 | −972 |
| 3 | −424 | −584 |
| 4 | −715 | −466 |
| 5 | −1155 | −335 |
| 6 | −627 | −243 |
| 7 | −402 | −183 |
| 8 | −165 | −459 |
| 9 | −385 | −378 |
| 10 | −160 | −716 |
| 11 | 77 | −594 |
| 12 | −198 | −277 |
| 13 | −204 | −115 |
| 14 | −6 | −362 |
| 15 | −22 | −173 |
| 16 | −841 | −86 |
| 17 | −1178 | 206 |
| 18 | −551 | 20 |
| 19 | −414 | 209 |
| 20 | −713 | 252 |
| 21 | −770 | 665 |
| 22 | −433 | 473 |
| 23 | −361 | 818 |
| 24 | −338 | 17 |
| 25 | −148 | 49 |
| 26 | −5 | −33 |
| 27 | −10 | 124 |
| 28 | −195 | 234 |
| 29 | −129 | 469 |
| 30 | 9 | 316 |
| 31 | −43 | 647 |
| 32 | 203 | −961 |
| 33 | 184 | −397 |
| 34 | 370 | −550 |
| 35 | 358 | −279 |
| 36 | 135 | −199 |
| 37 | 135 | −5 |
| 38 | 277 | −111 |
| 39 | 444 | −92 |
| 40 | 661 | −744 |
| 41 | 593 | −355 |
| 42 | 1193 | −634 |
| 43 | 933 | −432 |
| 44 | 797 | −191 |
| 45 | 611 | −66 |
| 46 | 1125 | −130 |
| 47 | 1700 | −24 |
| 48 | 143 | 183 |
| 49 | 288 | 262 |
| 50 | 307 | 60 |
| 51 | 478 | 153 |
| 52 | 189 | 457 |
| 53 | 78 | 967 |
| 54 | 445 | 393 |
| 55 | 386 | 693 |
| 56 | 819 | 67 |
| 57 | 681 | 266 |
| 58 | 1023 | 273 |
| 59 | 1351 | 281 |
| 60 | 708 | 551 |

-continued

Table of PRBA Sum [3, 4] VQ Codebook (6 Bit) Values

| n | x1(n) | x2(n) |
|---|---|---|
| 61 | 734 | 1016 |
| 62 | 983 | 618 |
| 63 | 1751 | 723 |

Table of PRBA Sum [5, 7] VQ Codebook (7 Bit) Values

| n | x1(n) | x2(n) | x3(n) |
|---|---|---|---|
| 0 | −473 | −644 | −166 |
| 1 | −334 | −483 | −439 |
| 2 | −688 | −460 | −147 |
| 3 | −387 | −391 | −108 |
| 4 | −613 | −253 | −264 |
| 5 | −291 | −207 | −322 |
| 6 | −592 | −230 | −30 |
| 7 | −334 | −92 | −127 |
| 8 | −226 | −276 | −108 |
| 9 | −140 | −345 | −264 |
| 10 | −248 | −805 | 9 |
| 11 | −183 | −506 | −108 |
| 12 | −205 | −92 | −595 |
| 13 | −22 | −92 | −244 |
| 14 | −151 | −138 | −30 |
| 15 | −43 | −253 | −147 |
| 16 | −822 | −308 | 208 |
| 17 | −372 | −563 | 80 |
| 18 | −557 | −518 | 240 |
| 19 | −253 | −548 | 368 |
| 20 | −504 | −263 | 160 |
| 21 | −319 | −158 | 48 |
| 22 | −491 | −173 | 528 |
| 23 | −279 | −233 | 288 |
| 24 | −239 | −368 | 64 |
| 25 | −94 | −563 | 176 |
| 26 | −147 | −338 | 224 |
| 27 | −107 | −338 | 528 |
| 28 | −133 | −203 | 96 |
| 29 | −14 | −263 | 32 |
| 30 | −107 | −98 | 352 |
| 31 | −1 | −248 | 256 |
| 32 | −494 | −52 | −345 |
| 33 | −239 | 92 | −257 |
| 34 | −485 | −72 | −32 |
| 35 | −383 | 153 | −82 |
| 36 | −375 | 194 | −407 |
| 37 | −205 | 543 | −382 |
| 38 | −536 | 379 | −57 |
| 39 | −247 | 338 | −207 |
| 40 | −171 | −72 | −220 |
| 41 | −35 | −72 | −395 |
| 42 | −188 | −11 | −32 |
| 43 | −26 | −52 | −95 |
| 44 | −94 | 71 | −207 |
| 45 | −9 | 338 | −245 |
| 46 | −154 | 153 | −70 |
| 47 | −18 | 215 | −132 |
| 48 | −709 | 78 | 78 |
| 49 | −316 | 78 | 78 |
| 50 | −462 | −57 | 234 |
| 51 | −226 | 100 | 273 |
| 52 | −259 | 325 | 117 |
| 53 | −192 | 618 | 0 |
| 54 | −507 | 213 | 312 |
| 55 | −226 | 348 | 390 |
| 56 | −68 | −57 | 78 |
| 57 | −34 | 33 | 19 |
| 58 | −192 | −57 | 156 |
| 59 | −192 | −12 | 585 |
| 60 | −113 | 123 | 117 |
| 61 | −57 | 280 | 19 |

-continued

Table of PRBA Sum [5, 7] VQ Codebook (7 Bit) Values

| n | x1(n) | x2(n) | x3(n) |
|---|---|---|---|
| 62 | −12 | 348 | 253 |
| 63 | −12 | 78 | 234 |
| 64 | 60 | −383 | −304 |
| 65 | 84 | −473 | −589 |
| 66 | 12 | −495 | −152 |
| 67 | 204 | −765 | −247 |
| 68 | 108 | −135 | −209 |
| 69 | 156 | −360 | −76 |
| 70 | 60 | −180 | −38 |
| 71 | 192 | −158 | −38 |
| 72 | 204 | −248 | −456 |
| 73 | 420 | −495 | −247 |
| 74 | 408 | −293 | −57 |
| 75 | 744 | −473 | −19 |
| 76 | 480 | −225 | −475 |
| 77 | 768 | −68 | −285 |
| 78 | 276 | −225 | −228 |
| 79 | 480 | −113 | −190 |
| 80 | 0 | −403 | 88 |
| 81 | 210 | −472 | 120 |
| 82 | 100 | −633 | 408 |
| 83 | 180 | −265 | 520 |
| 84 | 50 | −104 | 120 |
| 85 | 130 | −219 | 104 |
| 86 | 110 | −81 | 296 |
| 87 | 190 | −265 | 312 |
| 88 | 270 | −242 | 88 |
| 89 | 330 | −771 | 104 |
| 90 | 430 | −403 | 232 |
| 91 | 590 | −219 | 504 |
| 92 | 350 | −104 | 24 |
| 93 | 630 | −173 | 104 |
| 94 | 220 | −58 | 136 |
| 95 | 370 | −104 | 248 |
| 96 | 67 | 63 | −238 |
| 97 | 242 | −42 | −314 |
| 98 | 80 | 105 | −86 |
| 99 | 107 | −42 | −29 |
| 100 | 175 | 126 | −542 |
| 101 | 202 | 168 | −238 |
| 102 | 107 | 336 | −29 |
| 103 | 242 | 168 | −29 |
| 104 | 458 | 168 | −371 |
| 105 | 458 | 252 | −162 |
| 106 | 269 | 0 | −143 |
| 107 | 377 | 63 | −29 |
| 108 | 242 | 378 | −295 |
| 109 | 917 | 525 | −276 |
| 110 | 256 | 588 | −67 |
| 111 | 310 | 336 | 28 |
| 112 | 72 | 42 | 120 |
| 113 | 188 | 42 | 46 |
| 114 | 202 | 147 | 212 |
| 115 | 246 | 21 | 527 |
| 116 | 14 | 672 | 286 |
| 117 | 43 | 189 | 101 |
| 118 | 57 | 147 | 379 |
| 119 | 159 | 420 | 527 |
| 120 | 391 | 105 | 138 |
| 121 | 608 | 105 | 46 |
| 122 | 391 | 126 | 342 |
| 123 | 927 | 63 | 231 |
| 124 | 565 | 273 | 175 |
| 125 | 579 | 546 | 212 |
| 126 | 289 | 378 | 286 |
| 127 | 637 | 252 | 619 |

Table of PRBA Dif [1, 3] VQ Codebook (8 Bit) Values

| n | x1(n) | x2(n) | x3(n) |
|---|---|---|---|
| 0 | −1153 | −430 | −504 |
| 1 | −1001 | −626 | −861 |
| 2 | −1240 | −846 | −252 |
| 3 | −805 | −748 | −252 |
| 4 | 1675 | −381 | −336 |
| 5 | −1175 | −111 | −546 |
| 6 | −892 | −307 | −315 |
| 7 | −762 | −111 | −336 |
| 8 | −566 | −405 | −735 |
| 9 | −501 | −846 | −483 |
| 10 | −631 | −503 | −420 |
| 11 | −370 | −479 | −252 |
| 12 | −523 | −307 | −462 |
| 13 | −327 | −185 | −294 |
| 14 | −631 | −332 | −231 |
| 15 | −544 | −136 | −273 |
| 16 | −1170 | −348 | −24 |
| 17 | −949 | −564 | −96 |
| 18 | −897 | −372 | 120 |
| 19 | −637 | −828 | 144 |
| 20 | −845 | −108 | −96 |
| 21 | −676 | −132 | 120 |
| 22 | −910 | −324 | 552 |
| 23 | −624 | −108 | 432 |
| 24 | −572 | −492 | −168 |
| 25 | −416 | −276 | −24 |
| 26 | −598 | −420 | 48 |
| 27 | −390 | −324 | 335 |
| 28 | −494 | −108 | −96 |
| 29 | −429 | −276 | −168 |
| 30 | −533 | −252 | 144 |
| 31 | −364 | −180 | 168 |
| 32 | −1114 | 107 | −280 |
| 33 | −676 | 64 | −249 |
| 34 | −1333 | −86 | −125 |
| 35 | −913 | 193 | −233 |
| 36 | −1460 | 258 | −249 |
| 37 | −1114 | 473 | 481 |
| 38 | −949 | 451 | −109 |
| 39 | −639 | 559 | −140 |
| 40 | −384 | −43 | −357 |
| 41 | −329 | 43 | −187 |
| 42 | −603 | 43 | −47 |
| 43 | −365 | 86 | −1 |
| 44 | −566 | 408 | −404 |
| 45 | −329 | 387 | −218 |
| 46 | −603 | 258 | −202 |
| 47 | −511 | 193 | −16 |
| 48 | −1089 | 94 | 77 |
| 49 | −732 | 157 | 58 |
| 50 | −1482 | 178 | 311 |
| 51 | −1014 | −53 | 370 |
| 52 | −751 | 199 | 292 |
| 53 | −582 | 388 | 136 |
| 54 | −789 | 220 | 604 |
| 55 | −751 | 598 | 389 |
| 56 | −432 | −32 | 214 |
| 57 | −414 | −53 | 19 |
| 58 | −526 | 157 | 233 |
| 59 | −320 | 136 | 233 |
| 60 | −376 | 304 | 38 |
| 61 | −357 | 325 | 214 |
| 62 | −470 | 388 | 350 |
| 63 | −357 | 199 | 428 |
| 64 | −285 | −592 | −589 |
| 65 | −245 | −345 | −342 |
| 66 | −315 | −867 | −228 |
| 67 | −205 | −400 | −114 |
| 68 | −270 | −97 | −570 |
| 69 | −170 | −97 | −342 |
| 70 | −280 | −235 | −152 |
| 71 | −260 | −97 | −114 |
| 72 | −130 | −592 | −266 |
| 73 | −40 | −290 | −646 |
| 74 | −110 | −235 | −228 |

-continued

Table of PRBA Dif [1, 3] VQ Codebook (8 Bit) Values

| n | x1(n) | x2(n) | x3(n) |
|---|---|---|---|
| 75 | −35 | −235 | −57 |
| 76 | −35 | −97 | −247 |
| 77 | −10 | −15 | −152 |
| 78 | −120 | −152 | −133 |
| 79 | −85 | −42 | −76 |
| 80 | −295 | −472 | 86 |
| 81 | −234 | −248 | 0 |
| 82 | −234 | −216 | 602 |
| 83 | −172 | −520 | 301 |
| 84 | −286 | −40 | 21 |
| 85 | −177 | −88 | 0 |
| 86 | −253 | −72 | 322 |
| 87 | −191 | −136 | 129 |
| 88 | −53 | −168 | 21 |
| 89 | −48 | −328 | 86 |
| 90 | −105 | −264 | 236 |
| 91 | −67 | −136 | 129 |
| 92 | −53 | −40 | 21 |
| 93 | −6 | −104 | −43 |
| 94 | −105 | −40 | 193 |
| 95 | −29 | −40 | 344 |
| 96 | −176 | 123 | −208 |
| 97 | −143 | 0 | −182 |
| 98 | −309 | 184 | −156 |
| 99 | −205 | 20 | −91 |
| 100 | −276 | 205 | −403 |
| 101 | −229 | 615 | −234 |
| 102 | −238 | 225 | −13 |
| 103 | −162 | 307 | −91 |
| 104 | −81 | 61 | −117 |
| 105 | −10 | 102 | −221 |
| 106 | −105 | 20 | −39 |
| 107 | −48 | 82 | −26 |
| 108 | −124 | 328 | −286 |
| 109 | −24 | 205 | −143 |
| 110 | −143 | 164 | −78 |
| 111 | −20 | 389 | −104 |
| 112 | −270 | 90 | 93 |
| 113 | −185 | 72 | 0 |
| 114 | −230 | 0 | 186 |
| 115 | −131 | 108 | 124 |
| 116 | −243 | 558 | 0 |
| 117 | −212 | 432 | 155 |
| 118 | −171 | 234 | 186 |
| 119 | −158 | 126 | 279 |
| 120 | −108 | 0 | 93 |
| 121 | −36 | 54 | 62 |
| 122 | −41 | 144 | 480 |
| 123 | 0 | 54 | 170 |
| 124 | −90 | 180 | 62 |
| 125 | 4 | 162 | 0 |
| 126 | −117 | 558 | 356 |
| 127 | −81 | 342 | 77 |
| 128 | 52 | −363 | −357 |
| 129 | 52 | −231 | −186 |
| 130 | 37 | −627 | 15 |
| 131 | 42 | −396 | −155 |
| 132 | 33 | −66 | −465 |
| 133 | 80 | −66 | −140 |
| 134 | 71 | −165 | −31 |
| 135 | 90 | −33 | −16 |
| 136 | 151 | −198 | −140 |
| 137 | 332 | −1023 | −186 |
| 138 | 109 | −363 | 0 |
| 139 | 204 | −165 | −16 |
| 140 | 180 | −132 | −279 |
| 141 | 284 | −99 | −155 |
| 142 | 151 | −66 | −93 |
| 143 | 185 | −33 | 15 |
| 144 | 46 | −170 | 112 |
| 145 | 146 | −120 | 89 |
| 146 | 78 | −382 | 292 |
| 147 | 78 | −145 | 224 |
| 148 | 15 | −32 | 89 |
| 149 | 41 | −82 | 22 |

-continued

Table of PRBA Dif [1, 3] VQ Codebook (8 Bit) Values

| n | x1(n) | x2(n) | x3(n) |
|---|---|---|---|
| 150 | 10 | −70 | 719 |
| 151 | 115 | −32 | 89 |
| 152 | 162 | −282 | 134 |
| 153 | 304 | −345 | 22 |
| 154 | 225 | −270 | 674 |
| 155 | 335 | −407 | 359 |
| 156 | 256 | −57 | 179 |
| 157 | 314 | −182 | 112 |
| 158 | 146 | −45 | 404 |
| 159 | 241 | −195 | 292 |
| 160 | 27 | 96 | −89 |
| 161 | 56 | 128 | −362 |
| 162 | 4 | 0 | −30 |
| 163 | 103 | 32 | −69 |
| 164 | 18 | 432 | −459 |
| 165 | 61 | 256 | −615 |
| 166 | 94 | 272 | −206 |
| 167 | 99 | 144 | −50 |
| 168 | 113 | 16 | −225 |
| 169 | 298 | 80 | −362 |
| 170 | 213 | 48 | −50 |
| 171 | 255 | 32 | −186 |
| 172 | 156 | 144 | −167 |
| 173 | 265 | 320 | −245 |
| 174 | 122 | 496 | −30 |
| 175 | 298 | 176 | −69 |
| 176 | 56 | 66 | 45 |
| 177 | 61 | 145 | 112 |
| 178 | 32 | 225 | 270 |
| 179 | 99 | 13 | 225 |
| 180 | 28 | 304 | 45 |
| 181 | 118 | 251 | 0 |
| 182 | 118 | 808 | 697 |
| 183 | 142 | 437 | 157 |
| 184 | 156 | 92 | 45 |
| 185 | 317 | 13 | 22 |
| 186 | 194 | 145 | 270 |
| 187 | 260 | 66 | 90 |
| 188 | 194 | 834 | 45 |
| 189 | 327 | 225 | 45 |
| 190 | 189 | 278 | 495 |
| 191 | 199 | 225 | 135 |
| 192 | 336 | −205 | −390 |
| 193 | 364 | −740 | −656 |
| 194 | 336 | −383 | −144 |
| 195 | 448 | −281 | −349 |
| 196 | 420 | 25 | −103 |
| 197 | 476 | −26 | −267 |
| 198 | 336 | −128 | −21 |
| 199 | 476 | −205 | −41 |
| 200 | 616 | −562 | −308 |
| 201 | 2100 | −460 | −164 |
| 202 | 644 | −358 | −103 |
| 203 | 1148 | −434 | −62 |
| 204 | 672 | −230 | −595 |
| 205 | 1344 | −332 | −615 |
| 206 | 644 | −52 | −164 |
| 207 | 896 | −205 | −287 |
| 208 | 460 | −363 | 176 |
| 209 | 560 | −660 | 0 |
| 210 | 360 | −924 | 572 |
| 211 | 360 | −627 | 198 |
| 212 | 420 | −99 | 308 |
| 213 | 540 | −66 | 154 |
| 214 | 380 | 99 | 396 |
| 215 | 500 | −66 | 572 |
| 216 | 780 | −264 | 66 |
| 217 | 1620 | −165 | 198 |
| 218 | 640 | −165 | 308 |
| 219 | 840 | −561 | 374 |
| 220 | 560 | 66 | 44 |
| 221 | 820 | 0 | 110 |
| 222 | 760 | −66 | 660 |
| 223 | 860 | −99 | 396 |
| 224 | 672 | 246 | −360 |

-continued

Table of PRBA Dif [1, 3] VQ Codebook (8 Bit) Values

| n | x1(n) | x2(n) | x3(n) |
|---|---|---|---|
| 225 | 840 | 101 | −144 |
| 226 | 504 | 217 | −90 |
| 227 | 714 | 246 | 0 |
| 228 | 462 | 681 | −378 |
| 229 | 693 | 536 | −234 |
| 230 | 399 | 420 | −18 |
| 231 | 882 | 797 | 18 |
| 232 | 1155 | 188 | −216 |
| 233 | 1722 | 217 | −396 |
| 234 | 987 | 275 | 108 |
| 235 | 1197 | 130 | 126 |
| 236 | 1281 | 594 | −180 |
| 237 | 1302 | 1000 | −432 |
| 238 | 1155 | 565 | 108 |
| 239 | 1638 | 304 | 72 |
| 240 | 403 | 118 | 183 |
| 241 | 557 | 295 | 131 |
| 242 | 615 | 265 | 376 |
| 243 | 673 | 324 | 673 |
| 244 | 384 | 560 | 183 |
| 245 | 673 | 501 | 148 |
| 246 | 365 | 442 | 411 |
| 247 | 384 | 324 | 236 |
| 248 | 827 | 147 | 323 |
| 249 | 961 | 413 | 411 |
| 250 | 1058 | 177 | 463 |
| 251 | 1443 | 147 | 446 |
| 252 | 1000 | 1032 | 166 |
| 253 | 1558 | 708 | 253 |
| 254 | 692 | 678 | 411 |
| 255 | 1154 | 708 | 481 |

Table of PRBA Dif [1, 3] VQ Codebook (8 Bit) Values

| n | x1(n) | x2(n) | x3(n) | x4(n) |
|---|---|---|---|---|
| 0 | −279 | −330 | −261 | 7 |
| 1 | −465 | −242 | −9 | 7 |
| 2 | −248 | −66 | −189 | 7 |
| 3 | −279 | −44 | 27 | 217 |
| 4 | −217 | −198 | −189 | −233 |
| 5 | −155 | −154 | −81 | −53 |
| 6 | −62 | −110 | −117 | 157 |
| 7 | 0 | −44 | −153 | −53 |
| 8 | −186 | −110 | 63 | −203 |
| 9 | −310 | 0 | 207 | −53 |
| 10 | −155 | −242 | 99 | 187 |
| 11 | −155 | −88 | 63 | 7 |
| 12 | −124 | −330 | 27 | −23 |
| 13 | 0 | −110 | 207 | −113 |
| 14 | −62 | −22 | 27 | 157 |
| 15 | −93 | 0 | 279 | 127 |
| 16 | −413 | 48 | −93 | −115 |
| 17 | −203 | 96 | −56 | −23 |
| 18 | −443 | 168 | −130 | 138 |
| 19 | −143 | 288 | −130 | 115 |
| 20 | −113 | 0 | −93 | −138 |
| 21 | −53 | 240 | −241 | −115 |
| 22 | −83 | 72 | −130 | 92 |
| 23 | −53 | 192 | −19 | −23 |
| 24 | −113 | 48 | 129 | −92 |
| 25 | −323 | 240 | 129 | −92 |
| 26 | −83 | 72 | 92 | 46 |
| 27 | −263 | 120 | 92 | 69 |
| 28 | −23 | 168 | 314 | −69 |
| 29 | −53 | 360 | 92 | −138 |
| 30 | −23 | 0 | −19 | 0 |
| 31 | 7 | 192 | 55 | 207 |
| 32 | 7 | −275 | −296 | |
| 33 | 63 | −209 | −72 | −15 |

-continued

Table of PRBA Dif [1, 3] VQ Codebook (8 Bit) Values

| n | x1(n) | x2(n) | x3(n) | x4(n) |
|---|---|---|---|---|
| 34 | 91 | −253 | −8 | 225 |
| 35 | 91 | −55 | −40 | 45 |
| 36 | 119 | −99 | −72 | −225 |
| 37 | 427 | −77 | −72 | −135 |
| 38 | 399 | −121 | −200 | 105 |
| 39 | 175 | 33 | −104 | −75 |
| 40 | 7 | −99 | 24 | −75 |
| 41 | 91 | 11 | 88 | −15 |
| 42 | 119 | −165 | 152 | 45 |
| 43 | 35 | −55 | 88 | 75 |
| 44 | 231 | −319 | 120 | −105 |
| 45 | 231 | −55 | 184 | −165 |
| 46 | 259 | −143 | −8 | 15 |
| 47 | 371 | −11 | 152 | 45 |
| 48 | 60 | 71 | −63 | −55 |
| 49 | 12 | 159 | −63 | −241 |
| 50 | 60 | 71 | −21 | 69 |
| 51 | 60 | 115 | −105 | 162 |
| 52 | 108 | 5 | −357 | −148 |
| 53 | 372 | 93 | −231 | −179 |
| 54 | 132 | 5 | −231 | 100 |
| 55 | 180 | 225 | −147 | 7 |
| 56 | 36 | 27 | 63 | −148 |
| 57 | 60 | 203 | 105 | −24 |
| 58 | 108 | 93 | 189 | 100 |
| 59 | 156 | 335 | 273 | 69 |
| 60 | 204 | 93 | 21 | 38 |
| 61 | 252 | 159 | 63 | −148 |
| 62 | 180 | 5 | 21 | 224 |
| 63 | 348 | 269 | 63 | 69 |

Table of HOC Sum0 VQ Codebook (7 Bit) Values

| n | x1(n) | x2(n) | x3(n) | x4(n) |
|---|---|---|---|---|
| 0 | −1087 | −987 | −785 | −114 |
| 1 | −742 | −903 | −639 | −570 |
| 2 | −1363 | −567 | −639 | −342 |
| 3 | −604 | −315 | −639 | −456 |
| 4 | −1501 | −1491 | −712 | 1026 |
| 5 | −949 | −819 | −274 | 0 |
| 6 | −880 | −399 | −493 | −114 |
| 7 | −742 | −483 | −566 | 342 |
| 8 | −880 | −651 | 237 | −114 |
| 9 | −742 | −483 | −201 | −342 |
| 10 | −1294 | −231 | −128 | −114 |
| 11 | −1156 | −315 | −128 | −684 |
| 12 | −1639 | −819 | 18 | 0 |
| 13 | −604 | −567 | 18 | 342 |
| 14 | −949 | −315 | 310 | 456 |
| 15 | −811 | −315 | −55 | 114 |
| 16 | −384 | −666 | −282 | −593 |
| 17 | −358 | −1170 | −564 | −198 |
| 18 | −514 | −522 | −376 | −119 |
| 19 | −254 | −378 | −188 | −277 |
| 20 | −254 | −666 | −940 | −40 |
| 21 | −228 | −378 | −376 | 118 |
| 22 | −566 | −162 | −564 | 118 |
| 23 | −462 | −234 | −188 | 39 |
| 24 | −436 | −306 | 94 | −198 |
| 25 | −436 | −738 | 0 | −119 |
| 26 | −436 | −306 | 376 | −119 |
| 27 | −332 | −90 | 188 | 39 |
| 28 | −280 | −378 | −94 | 592 |
| 29 | −254 | −450 | 94 | 118 |
| 30 | −618 | −162 | 188 | 118 |
| 31 | −228 | −234 | 470 | 355 |
| 32 | −1806 | −49 | −245 | −358 |
| 33 | −860 | −49 | −245 | −199 |
| 34 | −602 | 341 | −49 | −358 |

-continued

Table of HOC Sum0 VQ Codebook (7 Bit) Values

| n | x1(n) | x2(n) | x3(n) | x4(n) |
|---|---|---|---|---|
| 35 | −602 | 146 | −931 | −252 |
| 36 | −774 | 81 | 49 | 13 |
| 37 | −602 | 81 | 49 | 384 |
| 38 | −946 | 341 | −441 | 225 |
| 39 | −688 | 406 | −147 | −93 |
| 40 | −860 | −49 | 147 | −411 |
| 41 | −688 | 211 | 245 | −199 |
| 42 | −1290 | 276 | 49 | −305 |
| 43 | −774 | 926 | 147 | −252 |
| 44 | −1462 | 146 | 343 | 66 |
| 45 | −1032 | −49 | 441 | −40 |
| 46 | −946 | 471 | 147 | 172 |
| 47 | −516 | 211 | 539 | 172 |
| 48 | −481 | −28 | −290 | −435 |
| 49 | −277 | −28 | −351 | −195 |
| 50 | −345 | 687 | −107 | −375 |
| 51 | −294 | 247 | −107 | −135 |
| 52 | −362 | 27 | −46 | −15 |
| 53 | −328 | 82 | −290 | 345 |
| 54 | −464 | 192 | −229 | 45 |
| 55 | −396 | 467 | −351 | 105 |
| 56 | −396 | −83 | 442 | −435 |
| 57 | −243 | 82 | 259 | −255 |
| 58 | −447 | 82 | 15 | −255 |
| 59 | −294 | 742 | 564 | −135 |
| 60 | −260 | −83 | 15 | 225 |
| 61 | −243 | 192 | 259 | 465 |
| 62 | −328 | 247 | 137 | −15 |
| 63 | −226 | 632 | 137 | 105 |
| 64 | −170 | −641 | −436 | −221 |
| 65 | 130 | −885 | −187 | −273 |
| 66 | −30 | −153 | −519 | −377 |
| 67 | 30 | −519 | −851 | −533 |
| 68 | −170 | −214 | −602 | −65 |
| 69 | −70 | −641 | −270 | 247 |
| 70 | −150 | −214 | −104 | 39 |
| 71 | −10 | −31 | −270 | 195 |
| 72 | 10 | −458 | 394 | −117 |
| 73 | 70 | −519 | −21 | −221 |
| 74 | −130 | −275 | 145 | −481 |
| 75 | −110 | −31 | 62 | −221 |
| 76 | −110 | −641 | 228 | 91 |
| 77 | 70 | −275 | −21 | 39 |
| 78 | −90 | −214 | 145 | −65 |
| 79 | −30 | 30 | −21 | 39 |
| 80 | 326 | −587 | −490 | −72 |
| 81 | 821 | −252 | −490 | −186 |
| 82 | 146 | −252 | −266 | −72 |
| 83 | 506 | −185 | −210 | −357 |
| 84 | 281 | −252 | −378 | 270 |
| 85 | 551 | −319 | −154 | 156 |
| 86 | 416 | −51 | −266 | −15 |
| 87 | 596 | 16 | −378 | 384 |
| 88 | 506 | −319 | 182 | −243 |
| 89 | 776 | −721 | 70 | 99 |
| 90 | 236 | −185 | 70 | −186 |
| 91 | 731 | −51 | 126 | 99 |
| 92 | 191 | −386 | −98 | 156 |
| 93 | 281 | −989 | −154 | 498 |
| 94 | 281 | −185 | 14 | 213 |
| 95 | 281 | −386 | 350 | 156 |
| 96 | −18 | 144 | −254 | −192 |
| 97 | 97 | 144 | −410 | 0 |
| 98 | −179 | 464 | −410 | −256 |
| 99 | 28 | 464 | −98 | −192 |
| 100 | −156 | 144 | −176 | 64 |
| 101 | 143 | 80 | −98 | 0 |
| 102 | −133 | 336 | −98 | 192 |
| 103 | 143 | 656 | −488 | 128 |
| 104 | −133 | 208 | −20 | −576 |
| 105 | 74 | 16 | 448 | −192 |
| 106 | −18 | 208 | 58 | −128 |
| 107 | 120 | 976 | 58 | 0 |
| 108 | 5 | 144 | 370 | 192 |
| 109 | 120 | 80 | 136 | 384 |

-continued

Table of HOC Sum0 VQ Codebook (7 Bit) Values

| n | x1(n) | x2(n) | x3(n) | x4(n) |
|---|---|---|---|---|
| 110 | 74 | 464 | 682 | 256 |
| 111 | 120 | 464 | 136 | 64 |
| 112 | 181 | 96 | −43 | −400 |
| 113 | 379 | 182 | −215 | −272 |
| 114 | 313 | 483 | −559 | −336 |
| 115 | 1105 | 225 | −43 | −80 |
| 116 | 181 | 225 | −559 | 240 |
| 117 | 643 | 182 | −473 | −80 |
| 118 | 313 | 225 | −129 | 112 |
| 119 | 511 | 397 | −43 | −16 |
| 120 | 379 | 139 | 215 | 48 |
| 121 | 775 | 182 | 559 | 48 |
| 122 | 247 | 354 | 301 | −272 |
| 123 | 643 | 655 | 301 | −16 |
| 124 | 247 | 53 | 731 | 176 |
| 125 | 445 | 10 | 215 | 560 |
| 126 | 577 | 526 | 215 | 368 |
| 127 | 1171 | 569 | 387 | 176 |

Table of Frequency Block Sizes

| Total number of sub-frame magnitudes | Number of magnitudes for Frequency Block 1 | Number of magnitudes for Frequency Block 2 | Number of magnitudes for Frequency Block 3 | Number of magnitudes for Frequency Block 4 |
|---|---|---|---|---|
| 9 | 2 | 2 | 2 | 3 |
| 10 | 2 | 2 | 3 | 3 |
| 11 | 2 | 3 | 3 | 3 |
| 12 | 2 | 3 | 3 | 4 |
| 13 | 3 | 3 | 3 | 4 |
| 14 | 3 | 3 | 4 | 4 |
| 15 | 3 | 3 | 4 | 5 |
| 16 | 3 | 4 | 4 | 5 |
| 17 | 3 | 4 | 5 | 5 |
| 18 | 4 | 4 | 5 | 5 |
| 19 | 4 | 4 | 5 | 6 |
| 20 | 4 | 4 | 6 | 6 |
| 21 | 4 | 5 | 6 | 6 |
| 22 | 4 | 5 | 6 | 7 |
| 23 | 5 | 5 | 6 | 7 |
| 24 | 5 | 5 | 7 | 7 |
| 25 | 5 | 6 | 7 | 7 |
| 26 | 5 | 6 | 7 | 8 |
| 27 | 5 | 6 | 8 | 8 |
| 28 | 6 | 6 | 8 | 8 |
| 29 | 6 | 6 | 8 | 9 |
| 30 | 6 | 7 | 8 | 9 |
| 31 | 6 | 7 | 9 | 9 |
| 32 | 6 | 7 | 9 | 10 |
| 33 | 7 | 7 | 9 | 10 |
| 34 | 7 | 8 | 9 | 10 |
| 35 | 7 | 8 | 10 | 10 |
| 36 | 7 | 8 | 10 | 11 |
| 37 | 8 | 8 | 10 | 11 |
| 38 | 8 | 9 | 10 | 11 |
| 39 | 8 | 9 | 11 | 11 |
| 40 | 8 | 9 | 11 | 12 |
| 41 | 8 | 9 | 11 | 13 |
| 42 | 8 | 9 | 12 | 13 |
| 43 | 8 | 10 | 12 | 13 |
| 44 | 9 | 10 | 12 | 13 |
| 45 | 9 | 10 | 12 | 14 |
| 46 | 9 | 10 | 13 | 14 |
| 47 | 9 | 11 | 13 | 14 |
| 48 | 10 | 11 | 13 | 14 |
| 49 | 10 | 11 | 13 | 15 |
| 50 | 10 | 11 | 14 | 15 |
| 51 | 10 | 12 | 14 | 15 |

-continued

Table of Frequency Block Sizes

| Total number of sub-frame magnitudes | Number of magnitudes for Frequency Block 1 | Number of magnitudes for Frequency Block 2 | Number of magnitudes for Frequency Block 3 | Number of magnitudes for Frequency Block 4 |
|---|---|---|---|---|
| 52 | 10 | 12 | 14 | 16 |
| 53 | 11 | 12 | 14 | 16 |
| 54 | 11 | 12 | 15 | 16 |
| 55 | 11 | 12 | 15 | 17 |
| 56 | 11 | 13 | 15 | 17 |

Table of HOC Dif3 VQ Codebook (3 Bit) Values

| n | x1(n) | x2(n) | x3(n) | x4(n) |
|---|---|---|---|---|
| 0 | −94 | −248 | 60 | 0 |
| 1 | 0 | −17 | −100 | −90 |
| 2 | −376 | −17 | 40 | 18 |
| 3 | −141 | 247 | −80 | 36 |
| 4 | 47 | −50 | −80 | 162 |
| 5 | 329 | −182 | 20 | −18 |
| 6 | 0 | 49 | 200 | 0 |
| 7 | 282 | 181 | −20 | −18 |

Table of HOC Sum3 VQ Codebook (7 Bit) Values

| n | x1(n) | x2(n) | x3(n) | x4(n) |
|---|---|---|---|---|
| 0 | −812 | −216 | −483 | −129 |
| 1 | −532 | −648 | −207 | −129 |
| 2 | −868 | −504 | 0 | 215 |
| 3 | −532 | −264 | −69 | 129 |
| 4 | −924 | −72 | 0 | 43 |
| 5 | −644 | −120 | −69 | −215 |
| 6 | −868 | −72 | −345 | 301 |
| 7 | −476 | −24 | −483 | 344 |
| 8 | −756 | −216 | 276 | 215 |
| 9 | −476 | −360 | 414 | 0 |
| 10 | −1260 | −120 | 0 | 258 |
| 11 | 476 | −264 | 69 | 430 |
| 12 | −924 | 24 | 552 | −43 |
| 13 | −644 | 72 | 276 | −129 |
| 14 | −476 | 24 | 0 | 43 |
| 15 | −420 | 24 | 345 | 172 |
| 16 | −390 | −357 | −406 | 0 |
| 17 | −143 | −471 | −350 | −186 |
| 18 | −162 | −471 | −182 | 310 |
| 19 | −143 | −699 | −350 | 186 |
| 20 | −390 | −72 | −350 | −310 |
| 21 | −219 | 42 | −126 | −186 |
| 22 | −333 | −72 | −182 | 62 |
| 23 | −181 | −129 | −238 | 496 |
| 24 | −371 | −243 | 154 | −124 |
| 25 | −200 | −300 | −14 | −434 |
| 26 | −295 | −813 | 154 | 124 |
| 27 | −181 | −471 | 42 | −62 |
| 28 | −333 | −129 | 434 | −310 |
| 29 | −105 | −72 | 210 | −62 |
| 30 | −257 | −186 | 154 | 124 |
| 31 | −143 | −243 | −70 | −62 |
| 32 | −704 | 195 | −366 | −127 |
| 33 | −448 | 91 | −183 | −35 |
| 34 | −576 | 91 | −122 | 287 |
| 35 | −448 | 299 | −244 | 103 |
| 36 | −1216 | 611 | −305 | 57 |
| 37 | −384 | 507 | −244 | −127 |
| 38 | −704 | 559 | −488 | 149 |

-continued

Table of HOC Sum3 VQ Codebook (7 Bit) Values

| n | x1(n) | x2(n) | x3(n) | x4(n) |
|---|---|---|---|---|
| 39 | −640 | 455 | −183 | 379 |
| 40 | −1344 | 351 | 122 | −265 |
| 41 | −640 | 351 | −61 | −35 |
| 42 | −960 | 299 | 61 | 149 |
| 43 | −512 | 351 | 244 | 333 |
| 44 | −896 | 507 | −61 | −127 |
| 45 | −576 | 455 | 244 | −311 |
| 46 | −768 | 611 | 427 | 11 |
| 47 | −576 | 871 | 0 | 103 |
| 48 | −298 | 118 | −435 | 29 |
| 49 | −196 | 290 | −195 | −29 |
| 50 | −349 | 247 | −15 | 87 |
| 51 | −196 | 247 | −255 | 261 |
| 52 | −400 | 677 | −555 | −203 |
| 53 | −349 | 333 | −15 | −435 |
| 54 | −264 | 419 | −75 | 435 |
| 55 | −213 | 720 | −255 | 87 |
| 56 | −349 | 204 | 45 | −203 |
| 57 | −264 | 75 | 165 | 29 |
| 58 | −264 | 75 | −15 | 261 |
| 59 | −145 | 118 | −15 | 29 |
| 60 | −298 | 505 | 45 | −145 |
| 61 | −179 | 290 | 345 | −203 |
| 62 | −315 | 376 | 225 | 29 |
| 63 | −162 | 462 | −15 | 145 |
| 64 | −76 | −129 | −424 | −59 |
| 65 | 57 | 43 | −193 | −247 |
| 66 | −19 | −86 | −578 | 270 |
| 67 | 133 | −258 | −270 | 176 |
| 68 | 19 | −43 | −39 | −12 |
| 69 | 190 | 0 | −578 | −200 |
| 70 | −76 | 0 | −193 | 129 |
| 71 | 171 | 0 | −193 | 35 |
| 72 | 95 | −258 | 269 | −12 |
| 73 | 152 | −602 | 115 | −153 |
| 74 | −76 | −301 | 346 | 411 |
| 75 | 190 | −473 | 38 | 176 |
| 76 | 19 | −172 | 115 | −294 |
| 77 | 76 | −172 | 577 | −153 |
| 78 | −38 | −215 | 38 | 129 |
| 79 | 114 | −86 | 38 | 317 |
| 80 | 208 | −338 | −132 | −144 |
| 81 | 649 | −1958 | −462 | −964 |
| 82 | 453 | −473 | −462 | 102 |
| 83 | 845 | −68 | −198 | 102 |
| 84 | 502 | −68 | −396 | −226 |
| 85 | 943 | −68 | 0 | −308 |
| 86 | 404 | −68 | −198 | 102 |
| 87 | 600 | 67 | −528 | 184 |
| 88 | 453 | −338 | 132 | −308 |
| 89 | 796 | −608 | 0 | −62 |
| 90 | 355 | −473 | 396 | 184 |
| 91 | 551 | −338 | 0 | 184 |
| 92 | 208 | −203 | 66 | −62 |
| 93 | 698 | −203 | 462 | −62 |
| 94 | 208 | −68 | 264 | 266 |
| 95 | 551 | −68 | 132 | 20 |
| 96 | −98 | 269 | −281 | −290 |
| 97 | 21 | 171 | 49 | −174 |
| 98 | 4 | 220 | −83 | 58 |
| 99 | 106 | 122 | −215 | 464 |
| 100 | 21 | 465 | −149 | −116 |
| 101 | 21 | 318 | −347 | 0 |
| 102 | −98 | 514 | −479 | 406 |
| 103 | 123 | 514 | −83 | 174 |
| 104 | −13 | 122 | 181 | −406 |
| 105 | 140 | 24 | 247 | −58 |
| 106 | −98 | 220 | 511 | 174 |
| 107 | −30 | 73 | 181 | 174 |
| 108 | 4 | 759 | 181 | −174 |
| 109 | 21 | 318 | 181 | 58 |
| 110 | 38 | 318 | 115 | 464 |
| 111 | 106 | 710 | 379 | 174 |
| 112 | 289 | 270 | −162 | −135 |
| 113 | 289 | 35 | −216 | −351 |

-continued

Table of HOC Sum3 VQ Codebook (7 Bit) Values

| n | x1(n) | x2(n) | x3(n) | x4(n) |
|---|---|---|---|---|
| 114 | 289 | 270 | −378 | 189 |
| 115 | 561 | 129 | −54 | −27 |
| 116 | 357 | 552 | −162 | −351 |
| 117 | 765 | 364 | −324 | −27 |
| 118 | 221 | 270 | −108 | 189 |
| 119 | 357 | 740 | −432 | 135 |
| 120 | 221 | 82 | 0 | 81 |
| 121 | 357 | 82 | 162 | −243 |
| 122 | 561 | 129 | −54 | 459 |
| 123 | 1241 | 129 | 108 | 189 |
| 124 | 221 | 364 | 162 | −189 |
| 125 | 425 | 505 | −54 | 27 |
| 126 | 425 | 270 | 378 | 135 |
| 127 | 765 | 364 | 108 | 135 |

Table of HOC Dif2 VQ Codebook (3 Bit) Values

| n | x1(n) | x2(n) | x3(n) | x4(n) |
|---|---|---|---|---|
| 0 | −224 | −237 | 15 | −9 |
| 1 | −36 | −27 | −195 | −27 |
| 2 | −365 | 113 | 36 | 9 |
| 3 | −36 | 288 | −27 | −9 |
| 4 | 58 | 8 | 57 | 171 |
| 5 | 199 | −237 | 57 | −9 |
| 6 | −36 | 8 | 120 | −81 |
| 7 | 340 | 113 | −48 | −9 |

Table of HOC Sum2 VQ Codebook (7 Bit) Values

| n | x1(n) | x2(n) | x3(n) | x4(n) |
|---|---|---|---|---|
| 0 | −738 | −670 | −429 | −179 |
| 1 | −450 | −335 | −99 | −53 |
| 2 | −450 | −603 | −99 | 115 |
| 3 | −306 | −201 | −231 | 157 |
| 4 | −810 | −201 | −33 | −137 |
| 5 | −378 | −134 | −231 | −305 |
| 6 | −1386 | −67 | 33 | −95 |
| 7 | −666 | −201 | −363 | 283 |
| 8 | −450 | −402 | 297 | −53 |
| 9 | −378 | −670 | 561 | −11 |
| 10 | −1098 | −402 | 231 | 325 |
| 11 | −594 | −1005 | 99 | −11 |
| 12 | −882 | 0 | 99 | 157 |
| 13 | −810 | −268 | 363 | −179 |
| 14 | −594 | −335 | 99 | 283 |
| 15 | −306 | −201 | 165 | 157 |
| 16 | −200 | −513 | −162 | −288 |
| 17 | −40 | −323 | −162 | −96 |
| 18 | −200 | −589 | −378 | 416 |
| 19 | −56 | −513 | −378 | −32 |
| 20 | −248 | −285 | −522 | 32 |
| 21 | −184 | −133 | −18 | −32 |
| 22 | −120 | −19 | −234 | 96 |
| 23 | −56 | −133 | −234 | 416 |
| 24 | −200 | −437 | −18 | 96 |
| 25 | −168 | −209 | 414 | −288 |
| 26 | −152 | −437 | 198 | 544 |
| 27 | −56 | −171 | 54 | 160 |
| 28 | −184 | −95 | 54 | −416 |
| 29 | −152 | −171 | 198 | −32 |
| 30 | −280 | −171 | 558 | 96 |
| 31 | −184 | −19 | 270 | 288 |
| 32 | −463 | 57 | −228 | 40 |
| 33 | −263 | 114 | −293 | −176 |

-continued

Table of HOC Sum2 VQ Codebook (7 Bit) Values

| n | x1(n) | x2(n) | x3(n) | x4(n) |
|---|---|---|---|---|
| 34 | −413 | 57 | 32 | 472 |
| 35 | −363 | 228 | −423 | 202 |
| 36 | −813 | 399 | −358 | −68 |
| 37 | −563 | 399 | 32 | −122 |
| 38 | −463 | 342 | −33 | 202 |
| 39 | −413 | 627 | −163 | 202 |
| 40 | −813 | 171 | 162 | −338 |
| 41 | −413 | 0 | 97 | −176 |
| 42 | −513 | 57 | 422 | −14 |
| 43 | −463 | 0 | 97 | 94 |
| 44 | −663 | 570 | 357 | −230 |
| 45 | −313 | 855 | 227 | −14 |
| 46 | −1013 | 513 | 162 | 40 |
| 47 | −813 | 228 | 552 | 256 |
| 48 | −225 | 82 | 0 | 63 |
| 49 | −63 | 246 | −80 | 63 |
| 50 | −99 | 82 | −80 | 273 |
| 51 | −27 | 246 | −320 | 63 |
| 52 | −81 | 697 | −240 | −357 |
| 53 | −45 | 410 | −640 | −147 |
| 54 | −261 | 369 | −160 | −105 |
| 55 | −63 | 656 | −80 | 63 |
| 56 | −261 | 205 | 240 | −21 |
| 57 | −99 | 82 | 0 | −147 |
| 58 | −171 | 287 | 560 | 105 |
| 59 | 9 | 246 | 160 | 189 |
| 60 | −153 | 287 | 0 | −357 |
| 61 | −99 | 287 | 400 | −315 |
| 62 | −225 | 492 | 240 | 231 |
| 63 | −45 | 328 | 80 | −63 |
| 64 | 105 | −989 | −124 | −102 |
| 65 | 185 | −453 | −289 | −372 |
| 66 | 145 | −788 | 41 | 168 |
| 67 | 145 | −252 | −289 | 168 |
| 68 | 5 | −118 | −234 | −57 |
| 69 | 165 | −118 | −179 | −282 |
| 70 | 145 | −185 | −69 | −57 |
| 71 | 225 | −185 | −14 | 303 |
| 72 | 105 | −185 | 151 | −237 |
| 73 | 225 | −587 | 261 | −282 |
| 74 | 65 | −386 | 151 | 78 |
| 75 | 305 | −252 | 371 | −147 |
| 76 | 245 | −51 | 96 | −57 |
| 77 | 265 | 16 | 316 | −237 |
| 78 | 45 | −185 | 536 | 78 |
| 79 | 205 | −185 | 261 | 213 |
| 80 | 346 | −544 | −331 | −30 |
| 81 | 913 | −298 | −394 | −207 |
| 82 | 472 | −216 | −583 | 29 |
| 83 | 598 | −339 | −142 | 206 |
| 84 | 472 | −175 | −268 | −207 |
| 85 | 598 | −52 | −205 | 29 |
| 86 | 346 | −11 | −457 | 442 |
| 87 | 850 | −52 | −205 | 383 |
| 88 | 346 | −380 | −16 | −30 |
| 89 | 724 | −626 | 47 | −89 |
| 90 | 409 | −380 | 236 | 206 |
| 91 | 1291 | −216 | −16 | 29 |
| 92 | 472 | −11 | 47 | −443 |
| 93 | 535 | −134 | 47 | −30 |
| 94 | 346 | −52 | −79 | 147 |
| 95 | 787 | −175 | 362 | 29 |
| 96 | 85 | 220 | −195 | −170 |
| 97 | 145 | 110 | −375 | −510 |
| 98 | 45 | 55 | −495 | −34 |
| 99 | 185 | 55 | −195 | 238 |
| 100 | 245 | 440 | −75 | −374 |
| 101 | 285 | 825 | −75 | 102 |
| 102 | 85 | 330 | −255 | 374 |
| 103 | 185 | 330 | −75 | 102 |
| 104 | 25 | 110 | 285 | −34 |
| 105 | 65 | 55 | −15 | 34 |
| 106 | 65 | 0 | 105 | 102 |
| 107 | 225 | 55 | 105 | 510 |
| 108 | 105 | 110 | 45 | −238 |

-continued

Table of HOC Sum2 VQ Codebook (7 Bit) Values

| n | x1(n) | x2(n) | x3(n) | x4(n) |
|---|---|---|---|---|
| 109 | 325 | 550 | 165 | −102 |
| 110 | 105 | 440 | 405 | 34 |
| 111 | 265 | 165 | 165 | 102 |
| 112 | 320 | 112 | −32 | −74 |
| 113 | 896 | 194 | −410 | 10 |
| 114 | 320 | 112 | −284 | 10 |
| 115 | 512 | 276 | −95 | 220 |
| 116 | 448 | 317 | −410 | −326 |
| 117 | 1280 | 399 | −32 | −74 |
| 118 | 384 | 481 | −473 | 220 |
| 119 | 448 | 399 | −158 | 10 |
| 120 | 512 | 71 | 157 | 52 |
| 121 | 640 | 276 | −32 | −74 |
| 122 | 320 | 153 | 472 | 220 |
| 123 | 896 | 30 | 31 | 52 |
| 124 | 512 | 276 | 283 | −242 |
| 125 | 832 | 645 | 31 | −74 |
| 126 | 448 | 522 | 157 | 304 |
| 127 | 960 | 276 | 409 | 94 |

Table of HOC Dif1 VQ Codebook (3 Bit) Values

| n | x1(n) | x2(n) | x3(n) | x4(n) |
|---|---|---|---|---|
| 0 | −173 | −285 | 5 | 28 |
| 1 | −35 | 19 | −179 | 76 |
| 2 | −357 | 57 | 51 | −20 |
| 3 | −127 | 285 | 51 | −20 |
| 4 | 11 | −19 | 5 | −116 |
| 5 | 333 | −171 | −41 | 28 |
| 6 | 11 | −19 | 143 | 124 |
| 7 | 333 | 209 | −41 | −36 |

Table of HOC Sum1 VQ Codebook (7 Bit) Values

| n | x1(n) | x2(n) | x3(n) | x4(n) |
|---|---|---|---|---|
| 0 | −380 | −528 | −363 | 71 |
| 1 | −380 | −528 | −13 | 14 |
| 2 | −1040 | −186 | −313 | −214 |
| 3 | −578 | −300 | −113 | −157 |
| 4 | −974 | −471 | −163 | 71 |
| 5 | −512 | −300 | −313 | 299 |
| 6 | −578 | −129 | 37 | 185 |
| 7 | −314 | −186 | −113 | 71 |
| 8 | −446 | −357 | 237 | −385 |
| 9 | −380 | −870 | 237 | 14 |
| 10 | −776 | −72 | 187 | −43 |
| 11 | −446 | −243 | 87 | −100 |
| 12 | −644 | −414 | 387 | 71 |
| 13 | −578 | −642 | 87 | 299 |
| 14 | −1304 | −15 | 237 | 128 |
| 15 | −644 | −300 | 187 | 470 |
| 16 | −221 | −452 | −385 | −309 |
| 17 | −77 | −200 | −165 | −179 |
| 18 | −221 | −200 | −110 | −504 |
| 19 | −149 | −200 | −440 | −114 |
| 20 | −221 | −326 | 0 | 276 |
| 21 | −95 | −662 | −165 | 406 |
| 22 | −95 | −32 | −220 | 16 |
| 23 | −23 | −158 | −440 | 146 |
| 24 | −167 | −410 | 220 | −114 |
| 25 | −95 | −158 | 110 | 16 |
| 26 | −203 | −74 | 220 | −244 |
| 27 | −59 | −74 | 385 | −114 |
| 28 | −275 | −116 | 165 | 211 |

-continued

Table of HOC Sum1 VQ Codebook (7 Bit) Values

| n | x1(n) | x2(n) | x3(n) | x4(n) |
|---|---|---|---|---|
| 29 | −5 | −452 | 220 | 341 |
| 30 | −113 | −74 | 330 | 471 |
| 31 | −77 | −116 | 0 | 211 |
| 32 | −642 | 57 | −143 | −406 |
| 33 | −507 | 0 | −371 | −70 |
| 34 | −1047 | 570 | −143 | −14 |
| 35 | −417 | 855 | −200 | 42 |
| 36 | −912 | 0 | −143 | 98 |
| 37 | −417 | 171 | −143 | 266 |
| 38 | −687 | 285 | 28 | 98 |
| 39 | −372 | 513 | −371 | 154 |
| 40 | −822 | 0 | 427 | −294 |
| 41 | −462 | 171 | 142 | −238 |
| 42 | −1047 | 342 | 313 | −70 |
| 43 | −507 | 570 | 142 | −406 |
| 44 | −552 | 114 | 313 | 434 |
| 45 | −462 | 57 | 28 | −70 |
| 46 | −507 | 342 | 484 | 210 |
| 47 | −507 | 513 | 85 | 42 |
| 48 | −210 | 40 | −140 | −226 |
| 49 | −21 | 0 | 0 | −54 |
| 50 | −336 | 360 | −210 | −226 |
| 51 | −126 | 280 | 70 | −312 |
| 52 | −252 | 200 | 0 | −11 |
| 53 | −63 | 160 | −420 | 161 |
| 54 | −168 | 240 | −210 | 32 |
| 55 | −42 | 520 | −280 | −54 |
| 56 | −336 | 0 | 350 | 32 |
| 57 | −126 | 240 | 420 | −269 |
| 58 | −315 | 320 | 280 | −54 |
| 59 | −147 | 600 | 140 | 32 |
| 60 | −336 | 120 | 70 | 161 |
| 61 | −63 | 120 | 140 | 75 |
| 62 | −210 | 360 | 70 | 333 |
| 63 | −63 | 200 | 630 | 118 |
| 64 | 168 | −793 | −315 | −171 |
| 65 | 294 | −273 | −378 | −399 |
| 66 | 147 | −117 | −126 | −57 |
| 67 | 231 | −169 | −378 | −114 |
| 68 | 0 | −325 | −63 | 0 |
| 69 | 84 | −481 | −252 | 171 |
| 70 | 105 | −221 | −189 | 228 |
| 71 | 294 | −273 | 0 | 456 |
| 72 | 126 | −585 | 0 | −114 |
| 73 | 147 | −325 | 252 | −228 |
| 74 | 147 | −169 | 63 | −171 |
| 75 | 315 | −13 | 567 | −171 |
| 76 | 126 | −377 | 504 | 57 |
| 77 | 147 | −273 | 63 | 57 |
| 78 | 63 | −169 | 252 | 171 |
| 79 | 273 | −117 | 63 | 57 |
| 80 | 736 | −332 | −487 | −96 |
| 81 | 1748 | −179 | −192 | −32 |
| 82 | 736 | −26 | −369 | −416 |
| 83 | 828 | −26 | −192 | −32 |
| 84 | 460 | −638 | −251 | 160 |
| 85 | 736 | −230 | −133 | 288 |
| 86 | 368 | −230 | −133 | 32 |
| 87 | 552 | −77 | −487 | 544 |
| 88 | 736 | −434 | 44 | −32 |
| 89 | 1104 | −332 | −74 | −32 |
| 90 | 460 | −281 | −15 | −224 |
| 91 | 644 | −281 | 398 | −160 |
| 92 | 368 | −791 | 221 | 32 |
| 93 | 460 | −383 | 103 | 32 |
| 94 | 644 | −281 | 162 | 224 |
| 95 | 1012 | −179 | 339 | 160 |
| 96 | 76 | 108 | −341 | −244 |
| 97 | 220 | 54 | −93 | −488 |
| 98 | 156 | 378 | −589 | −122 |
| 99 | 188 | 216 | −155 | 0 |
| 100 | 28 | 0 | −31 | 427 |
| 101 | 108 | 0 | 31 | 61 |
| 102 | −4 | 162 | −93 | 183 |
| 103 | 204 | 432 | −217 | 305 |

-continued

Table of HOC Sum1 VQ Codebook (7 Bit) Values

| n | x1(n) | x2(n) | x3(n) | x4(n) |
|---|---|---|---|---|
| 104 | 44 | 162 | 31 | −122 |
| 105 | 156 | 0 | 217 | −427 |
| 106 | 44 | 810 | 279 | −122 |
| 107 | 204 | 378 | 217 | −305 |
| 108 | 124 | 108 | 217 | 244 |
| 109 | 220 | 108 | 341 | −61 |
| 110 | 44 | 432 | 217 | 0 |
| 111 | 156 | 432 | 279 | 427 |
| 112 | 300 | −13 | −89 | −163 |
| 113 | 550 | 237 | −266 | −13 |
| 114 | 450 | 737 | −30 | −363 |
| 115 | 1050 | 387 | −30 | −213 |
| 116 | 300 | −13 | −384 | 137 |
| 117 | 350 | 87 | −89 | 187 |
| 118 | 300 | 487 | −89 | −13 |
| 119 | 900 | 237 | 443 | 37 |
| 120 | 500 | −13 | 88 | −63 |
| 121 | 700 | 187 | 442 | −13 |
| 122 | 450 | 237 | 29 | −263 |
| 123 | 700 | 387 | 88 | 37 |
| 124 | 300 | 187 | 88 | 37 |
| 125 | 350 | −13 | 324 | 237 |
| 126 | 600 | 237 | 29 | 387 |
| 127 | 700 | 687 | 442 | 187 |

Table of HOC Dif0 VQ Codebook (3 Bit) Values

| n | x1(n) | x2(n) | x3(n) | x4(n) |
|---|---|---|---|---|
| 0 | −558 | −117 | 0 | 0 |
| 1 | −248 | 195 | 88 | −22 |
| 2 | −186 | −312 | −176 | −44 |
| 3 | 0 | 0 | 0 | 77 |
| 4 | 0 | −117 | 154 | −88 |
| 5 | 62 | 156 | −176 | −55 |
| 6 | 310 | −156 | −66 | 22 |
| 7 | 372 | 273 | 110 | 33 |

What is claimed is:

1. A method of encoding speech into a 90 millisecond frame of bits for transmission across a satellite communication channel, the method comprising the steps of:

digitizing a speech signal into a sequence of digital speech samples;

dividing the digital speech samples into a sequence of subframes, each of the subframes comprising a plurality of the digital speech samples;

estimating a set of model parameters for each of the subframes; wherein the model parameters comprise a set of spectral magnitude parameters that represent spectral information for the subframe;

combining two consecutive subframes from the sequence of subframes into a block;

jointly quantizing the spectral magnitude parameters from both of the subframes within the block, wherein the joint quantization includes forming predicted spectral magnitude parameters from the quantized spectral magnitude parameters from a previous block, computing residual parameters as the difference between the spectral magnitude parameters and the predicted spectral magnitude parameters, combining the residual parameters from both of the subframes within the block, and using a plurality of vector quantizers to quantize the combined residual parameters into a set of encoded spectral bits;

adding redundant error control bits to the encoded spectral bits from each block to protect at least some of the encoded spectral bits within the block from bit errors; and combining the added redundant error control bits and encoded spectral bits from two consecutive blocks into a 90 millisecond frame of bits for transmission across a satellite communication channel.

2. The method of claim 1, wherein the spectral magnitude parameters correspond to a frequency-domain representation of a spectral envelope of the subframe.

3. The method of claim 1 wherein the combining of the residual parameters from both of the subframes within the block further comprises:

dividing the residual parameters from each of the subframes into a plurality of frequency blocks;

performing a linear transformation on the residual parameters within each of the frequency blocks to produce a set of transformed residual coefficients for each of the subframes;

grouping a minority of the transformed residual coefficients from all of the frequency blocks into a prediction residual block average (PRBA) vector and grouping the remaining transformed residual coefficients for each of the frequency blocks into a higher order coefficient (HOC) vector for the frequency block;

transforming the PRBA vector to produce a transformed PRBA vector and computing the vector sum and difference to combine the two transformed PRBA vectors from both of the subframes; and computing the vector sum and difference for each frequency block to combine the two HOC vectors from both of the subframes for that frequency block.

4. The method of claim 3 wherein the transformed residual coefficients are computed for each of the frequency blocks using a Discrete Cosine Transform (DCT) followed by a linear 2 by 2 transform on the two lowest order DCT coefficients.

5. The method of claim 4 wherein four frequency blocks are used and wherein the length of each frequency block is approximately proportional to a number of spectral magnitude parameters within the subframe.

6. The method of claim 3, wherein the plurality of vector quantizers includes a three way split vector quantizer using 8 bits plus 6 bits plus 7 bits applied to the PRBA vector sum and a two way split vector quantizer using 8 bits plus 6 bits applied to the PRBA vector difference.

7. The method of claim 6 wherein the frame of bits includes additional bits representing the error in the transformed residual coefficients which is introduced by the vector quantizers.

8. The method of claim 1 or 2, wherein the spectral magnitude parameters represent log spectral magnitudes estimated for a Multi-Band Excitation (MBE) speech model.

9. The method of claim 8, wherein the spectral magnitude parameters are estimated from a computed spectrum independently of a voicing state.

10. The method of claim 1 or 2, wherein the predicted spectral magnitude parameters are formed by applying a gain of less than unity to a linear interpolation of the quantized spectral magnitudes from the last subframe in the previous block.

11. The method of claim 1 or 2, wherein the redundant error control bits for each block are formed by a plurality of block codes including Golay codes and Hamming codes.

12. The method of claim 11, wherein the plurality of block codes consists of one [24,12] extended Golay code, three [23,12] Golay codes, and two [15,11] Hamming codes.

13. The method of claim 1 or 2, wherein the sequence of subframes nominally occurs at an interval of 22.5 milliseconds per subframe.

14. The method of claim 13, wherein the frame of bits consists of 312 bits in half-rate mode or 624 bits in full-rate mode.

15. A method of decoding speech from a 90 millisecond frame of bits received across a satellite communication channel, the method comprising the steps of:

dividing the frame of bits into two blocks of bits, wherein each block of bits represents two subframes of speech;

applying error control decoding to each block of bits using redundant error control bits included within the block to produce error decoded bits which are at least in part protected from bit errors;

using the error decoded bits to jointly reconstruct spectral magnitude parameters for both of the subframes within a block, wherein the joint reconstruction includes using a plurality of vector quantizer codebooks to reconstruct a set of combined residual parameters from which separate residual parameters for both of the subframes are computed, forming predicted spectral magnitude parameters from the reconstructed spectral magnitude parameters from a previous block, and adding the separate residual parameters to the predicted spectral magnitude parameters to form the reconstructed spectral magnitude parameters for each subframe within the block; and synthesizing a plurality of digital speech samples for each subframe using the reconstructed spectral magnitude parameters for the subframe.

16. The method of claim 15, wherein the spectral magnitude parameters correspond to a frequency-domain representation of a spectral envelope of the subframe.

17. The method of claim 15 wherein the computing of the separate residual parameters for both of the subframes from the combined residual parameters for the block comprises the further steps of:

dividing the combined residual parameters from the block into a plurality of frequency blocks;

forming a transformed PRBA sum and difference vector for the block;

forming a HOC sum and difference vector for each of the frequency blocks from the combined residual parameters;

applying an inverse sum and difference operation and an inverse transformation to the transformed PRBA sum and difference vectors to form the PRBA vectors for both of the subframes; and applying an inverse sum and difference operation to the HOC sum and difference vectors to form HOC vectors for both of the subframes for each of the frequency blocks; and combining the PRBA vector and the HOC vectors for each of the frequency blocks for each of the subframes to form the separate residual parameters for both of the subframes within the block.

18. The method of claim 17, wherein the transformed residual coefficients are computed for each of the frequency blocks using a Discrete Cosine Transform ("DCT") followed by a linear 2 by 2 transform on the two lowest order DCT coefficients.

19. The method of claim 18, wherein four frequency blocks are used and wherein the length of each frequency block is approximately proportional to the number of spectral magnitude parameters within the subframe.

20. The method of claim 17, wherein the plurality of vector quantizer codebooks includes a three way split vector quantizer codebook using 8 bits plus 6 bits plus 7 bits applied to the PRBA sum vector and a two way split vector quantizer codebook using 8 bits plus 6 bits applied to the PRBA difference vector.

21. The method of claim 20, wherein the frame of bits includes additional bits representing the error in the transformed residual coefficients which is introduced by the vector quantizer codebooks.

22. The method of claim 15 or 17, wherein the reconstructed spectral magnitude parameters represent the log spectral magnitudes used in a Multi-Band Excitation (MBE) speech model.

23. The method of claim 15 or 17, further comprising a decoder synthesizing a set of phase parameters using the reconstructed spectral magnitude parameters.

24. The method of claim 15 or 17, wherein the predicted spectral magnitude parameters are formed by applying a gain of less than unity to the linear interpolation of the quantized spectral magnitudes from the last subframe in the previous block.

25. The method of claim 15 or 17, wherein the error control bits for each block are formed by a plurality of block codes including Golay codes and Hamming codes.

26. The method of claim 25, wherein the plurality of block codes consists of one [24,12] extended Golay code, three [23,12] Golay codes, and two [15,11] Hamming codes.

27. The method of claim 15 or 17, wherein the subframes have a nominal duration of 22.5 milliseconds.

28. The method of claim 25, wherein the frame of bits consists of 312 bits in half-rate mode or 624 bits in full-rate mode.

29. An encoder for encoding speech into a 90 millisecond frame of bits for transmission across a satellite communication channel, the system including:

a digitizer configured to convert a speech signal into a sequence of digital speech samples;

a subframe generator configured to divide the digital speech samples into a sequence of subframes, each of the subframes comprising a plurality of the digital speech samples;

a model parameter estimator configured to estimate a set of model parameters for each of the subframes, wherein the model parameters comprise a set of spectral magnitude parameters that represent spectral information for the subframe;

a combiner configured to combine two consecutive subframes from the sequence of subframes into a block;

a dual-frame spectral magnitude quantizer configured to jointly quantize parameters from both of the subframes within the block, wherein the joint quantization includes forming predicted spectral magnitude parameters from the quantized spectral magnitude parameters from a previous block, computing residual parameters as the difference between the spectral magnitude parameters and the predicted spectral magnitude parameters, combining the residual parameters from both of the subframes within the block, and using a plurality of vector quantizers to quantize the combined residual parameters into a set of encoded spectral bits;

an error code encoder configured to add redundant error control bits to the encoded spectral bits from each block to protect at least some of the encoded spectral bits within the block from bit errors; and a combiner configured to combine the added redundant error control bits and encoded spectral bits from two consecutive blocks into a 90 millisecond frame of bits for transmission across a satellite communication channel.

30. The encoder of claim 29, wherein the dual-frame spectral magnitude quantizer is configured to combine the residual parameters from both of the subframes within the block by:

dividing the residual parameters from each of the subframes into a plurality of frequency blocks;

performing a linear transformation on the residual parameters within each of the frequency blocks to produce a set of transformed residual coefficients for each of the subframes;

grouping a minority of the transformed residual coefficients from all of the frequency blocks into a PRBA vector and grouping the remaining transformed residual coefficients for each of the frequency blocks into a HOC vector for the frequency block;

transforming the PRBA vector to produce a transformed PRBA vector and computing the vector sum and difference to combine the two transformed PRBA vectors from both of the subframes; and computing the vector sum and difference for each frequency block to combine the two HOC vectors from both of the subframes for that frequency block.

31. The encoder of claim 29, wherein the spectral magnitude parameters correspond to a frequency-domain representation of a spectral envelope of the subframe.

32. A decoder for decoding speech from a 90 millisecond frame of bits received across a satellite communication channel, the decoder including:

a divider configured to divide the frame of bits into two blocks of bits, wherein each block of bits represents two subframes of speech;

an error control decoder configured to error decode each block of bits using redundant error control bits included within the block to produce error decoded bits which are at least in part protected from bit errors;

a dual-frame spectral magnitude reconstructor configured to jointly reconstruct spectral magnitude parameters for both of the subframes within a block, wherein the joint reconstruction includes using a plurality of vector quantizer codebooks to reconstruct a set of combined residual parameters from which separate residual parameters for both of the subframes are computed, forming predicted spectral magnitude parameters from the reconstructed spectral magnitude parameters from a previous block, and adding the separate residual parameters to the predicted spectral magnitude parameters to form the reconstructed spectral magnitude parameters for each subframe within the block; and a synthesizer configured to synthesize a plurality of digital speech samples for each subframe using the reconstructed spectral magnitude parameters for the subframe.

33. The decoder of claim 32, wherein the dual-frame spectral magnitude quantizer is configured to compute the separate residual parameters for both of the subframes from the combined residual parameters for the block by:

dividing the combined residual parameters from the block into a plurality of frequency blocks;

forming a transformed PRBA sum and difference vector for the block;

forming a HOC sum and difference vector for each of the frequency blocks from the combined residual parameters;

applying an inverse sum and difference operation and an inverse transformation to the transformed PRBA sum and difference vectors to form the PRBA vectors for both of the subframes; and applying an inverse sum and difference operation to the HOC sum and difference vectors to form HOC vectors for both of the subframes for each of the frequency blocks; and combining the PRBA vector and the HOC vectors for each of the frequency blocks for each of the subframes to form the separate residual parameters for both of the subframes within the block.

34. The decoder of claim 32, wherein the spectral magnitude parameters correspond to a frequency-domain representation of a spectral envelope of the subframe.

* * * * *